US011289063B1

(12) United States Patent
Flore et al.

(10) Patent No.: US 11,289,063 B1
(45) Date of Patent: Mar. 29, 2022

(54) HYGIENIC WHISTLE WITH ENHANCED SOUND-GENERATING CHAMBER

(71) Applicant: Whistle Shield LLC, Pittsburgh, PA (US)

(72) Inventors: Adam M. Flore, Pittsburgh, PA (US); Ryan Martin, Mechanicsville, VA (US); Christopher Murray, Richmond, VA (US); Viatcheslav Orlov, Richmond, VA (US)

(73) Assignee: Whistle Shield LLC, Pittsburgh, PA (US)

( * ) Notice: Subject to any disclaimer, the term of this patent is extended or adjusted under 35 U.S.C. 154(b) by 0 days.

(21) Appl. No.: 17/365,086

(22) Filed: Jul. 1, 2021

Related U.S. Application Data

(60) Provisional application No. 63/053,430, filed on Jul. 17, 2020.

(51) Int. Cl.
*G10K 5/00* (2006.01)

(52) U.S. Cl.
CPC ..... *G10K 5/00* (2013.01)

(58) Field of Classification Search
CPC ..... G10K 5/00
See application file for complete search history.

(56) References Cited

U.S. PATENT DOCUMENTS 696,814 A * 4/1902 Hatch ..... G10K 5/00 446/206
1,171,163 A 2/1916 Allen
2,056,623 A * 10/1936 Scott ..... G10K 5/00 446/206
2,700,316 A * 1/1955 Gordon et al. ..... G10K 9/04 84/330
2,724,212 A * 11/1955 Ferguson ..... A63H 5/00 446/204
2,794,341 A * 6/1957 Vonnegut ..... G01L 7/00 73/861.32
2,877,598 A * 3/1959 Seron ..... G10K 5/00 446/204
3,367,324 A * 2/1968 De Bono ..... A61B 5/08 600/540

(Continued)

FOREIGN PATENT DOCUMENTS

WO 1999014733 3/1999
WO 2008089533 7/2008

*Primary Examiner* — Nimeshkumar D Patel
*Assistant Examiner* — Tania Courson
(74) *Attorney, Agent, or Firm* — Leech Tishman Fuscaldo & Lampl, LLC

(57) ABSTRACT

A whistle is structured for promoting hygienic use of the whistle and for maximizing inlet air pressure to generate sound from the whistle. The whistle includes an air inlet having a channelizer for dividing and channeling air flow received from the air inlet through at least two different channels. A sound-generating chamber is in corresponding fluid communication with each of the channels, and an air exhaust is in fluid communication with the sound-generating chamber. The air exhaust is structured and located on the whistle body for generating a sound, and is positioned and structured at a location suitable for directing air flow away from the air exhaust in a generally downwardly and/or opposing direction with respect to a generally horizontal air flow direction at the air inlet.

11 Claims, 33 Drawing Sheets

(56) References Cited

U.S. PATENT DOCUMENTS 4,138,800 A * 2/1979 Lege ..... A01M 31/004 446/207
4,180,537 A * 12/1979 Danova ..... G10K 5/00 116/137 R
4,280,299 A * 7/1981 Oka ..... G10K 5/00 446/206
4,752,270 A * 6/1988 Morton ..... A01M 31/004 446/202
4,821,670 A 4/1989 Foxcroft et al.
5,049,107 A * 9/1991 De Nittis ..... G10H 1/26 446/397
5,329,872 A * 7/1994 Wright ..... G10K 5/00 116/137 R
5,546,887 A * 8/1996 Cameron ..... G10K 5/00 116/137 R
5,816,186 A 10/1998 Shepherd
6,125,998 A * 10/2000 Batista ..... A45F 5/00 206/37
6,250,247 B1 * 6/2001 Chu ..... G10K 5/00 116/137 R
6,413,139 B1 * 7/2002 Douglas ..... A01M 31/004 446/204
6,491,564 B1 * 12/2002 Miller ..... A63H 5/00 446/202
6,612,894 B2 * 9/2003 Carlton ..... A01M 31/004 446/202
6,837,177 B2 * 1/2005 Tanaka ..... G10K 5/00 116/137 R
D555,529 S 11/2007 Foxcroft et al.
7,357,693 B1 * 4/2008 Roberts ..... A01M 31/004 446/204
7,428,878 B2 * 9/2008 Kim ..... G10K 5/00 116/137 R
D621,290 S 8/2010 Foxcroft
D621,734 S 8/2010 Hills et al.
D622,171 S 8/2010 Hills et al.
D622,172 S 8/2010 Hills et al.
8,028,642 B2 10/2011 Foxcroft
D661,215 S 6/2012 Foxcroft et al.
8,776,713 B2 * 7/2014 Shishido ..... G10K 5/00 116/137 R
8,869,976 B1 * 10/2014 Smith ..... A45C 11/00 206/38
8,962,961 B2 2/2015 Masuda et al.
9,138,167 B1 * 9/2015 Leydon ..... A61M 15/0021
9,142,198 B2 9/2015 Suenaga
9,361,871 B1 * 6/2016 Truxes ..... G10K 5/00
D776,554 S 1/2017 Foxcroft
9,767,781 B2 * 9/2017 Miller ..... G10K 5/00
10,869,638 B2 * 12/2020 Leydon ..... A61B 5/0026
2003/0033970 A1 * 2/2003 Hills ..... G10K 5/00 116/137 R
2006/0243190 A1 * 11/2006 Cohen ..... G10K 11/02 116/137 R
2006/0272568 A1 * 12/2006 Neidlinger ..... G10K 5/00 116/137 R
2009/0084380 A1 * 4/2009 Gieschen ..... A61M 15/0031 128/203.15
2010/0261403 A1 * 10/2010 Shishido ..... G10K 5/00 446/204
2016/0284332 A1 * 9/2016 Miller ..... G10K 5/00
2019/0200709 A1 * 7/2019 Paik ..... G10K 5/00
2021/0128074 A1 * 5/2021 Leydon ..... A61B 5/0022

* cited by examiner

FIG. 31

FIG. 31. Experimental Design Matrix

| Environment | Distance | Gas Pressure (bar) |
|---|---|---|
| Indoor | 10' | 0.5, 1.0 |
| Indoor | 25' | 0.5, 1.0 |
| Outdoor | 10' | 0.5, 1.0 |
| Outdoor | 50' | 0.5, 1.0 |

Average sound level observations for indoor tests

| Environment | Distance | Cat Presence (bar) | Average Sound Level (dB) | |
|---|---|---|---|---|
| | | | Sweep Whistle | Rev. Whistle |
| Indoor | 10' | 0.5 | 86.6 | 95.1 |
| Indoor | 25' | 0.5 | 74.8 | 92.6 |
| Indoor | 10' | 1.0 | 98.3 | 96.4 |
| Indoor | 25' | 1.0 | 91.9 | 93.1 |
| Outdoor | 10' | 0.5 | 86.6 | 89.6 |
| Outdoor | 50' | 0.5 | 61.8 | 74.3 |
| Outdoor | 10' | 1.0 | 92.4 | 90.0 |
| Outdoor | 50' | 1.0 | 78.2 | 80.0 |

FIG. 32

Sound Level and Volume Comparison

| Whistle | Environment | Distance (ft) | Avg. Sound Level (dB) | Avg. Volume (L) | Avg. Loudness/Volume (dB/L) |
|---|---|---|---|---|---|
| Inv. Whistle | Inside | 10 | 95.7 | 1.74 | 56.7 |
| Existing Whistle | Inside | 10 | 92.5 | 1.76 | 54.6 |
| Inv. Whistle | Inside | 25 | 92.9 | 1.72 | 56.0 |
| Existing Whistle | Inside | 25 | 83.4 | 1.76 | 48.2 |
| Inv. Whistle | Outside | 10 | 89.8 | 1.73 | 54.1 |
| Existing Whistle | Outside | 10 | 89.3 | 2.28 | 46.8 |
| Inv. Whistle | Outside | 50 | 77.2 | 1.48 | 54.0 |
| Existing Whistle | Outside | 50 | 69.5 | 1.69 | 46.3 |

FIG. 33

HYGIENIC WHISTLE WITH ENHANCED SOUND-GENERATING CHAMBER

CROSS-REFERENCE TO RELATED APPLICATION/PRIORITY CLAIM

The present application is a non-provisional patent application claiming priority to U.S. Provisional patent application entitled "Whistle Shield" with Ser. No. 63/053,430, filed on Jul. 17, 2020, the entirety of which is hereby incorporated by reference into the present application.

FIELD OF THE INVENTION

In various embodiments, the present invention generally relates to whistles and similar devices for generating sound. More particularly, in certain embodiments of the invention, a whistle is provided which includes certain sound-producing structures designed to direct exhaust air flow in a hygienic manner in a downward direction with a reduced amount of inlet air pressure.

BACKGROUND

Whistles and similar sound-generating devices have a variety of different useful applications. For example, sports whistles can be used to direct the action of a sports event by, alerting players and other participants when play has begun or play has ended, such as during a basketball game or a football game. In other scenarios, whistles can be used by law enforcement to communicate instructions to vehicle drivers, for example, such as when to stop or when to proceed safely through a busy intersection. In another example, a whistle can be helpful for lifeguards protecting a swimming area to signal instructions or communicate warnings to swimmers in the guarded area. A physical education teacher may use a whistle to direct the activities of students taking a gym class. Coaches of athletics teams frequently use whistles to stop and start activity or play or otherwise communicate with their players during team practices, for example.

Whistles necessarily generate air exhaust as part of their sound-generating function. This can be problematic especially when the air exhaust exiting the whistle contains harmful aerosol particles such as viruses, bacteria, or other airborne contaminants or pathogens. A referee blowing a whistle while officiating a basketball game, for example, may unintentionally spread a viral-type infection to players or coaches on the basketball court during the game. Other deficiencies in conventional whistles include the amount of air pressure required to be blown through the inlet and sound-generating chambers of a whistle to generate a suitable sound from the whistle. Those users suffering from medical conditions or diseases such as asthma, chronic obstructive pulmonary disease (COPD), chronic bronchitis, or emphysema, among others, can often find it difficult to generate air pressure with the consistency and regularity necessary to use a whistle effectively. For example, a police officer with asthma who performs traffic control duties for an extended period of time may suffer medically from the need to use a whistle many times repeatedly throughout the course of a day's work of directing traffic.

Therefore, improved apparatuses and techniques are needed which embody a whistle structure that can effectively address the deficiencies and issues described above. For example, whistle devices and whistle-related structures are needed which can promote the hygienic use of a whistle, while reducing the amount of air pressure needed for effectively generating sound from the whistle.

SUMMARY

In various embodiments, a whistle is provided with a body portion having an air inlet structured for receiving air therein supplied by a source of air pressure applied to the air inlet; and, a channelizer in fluid communication with the air inlet, the channelizer configured for dividing air flow received from the air inlet through at least two channels. At least one sound-generating chamber corresponds to and is in fluid communication with each of the channels; and at least one air exhaust is in fluid communication with each sound-generating, chamber. The whistle can include an air exhaust structured for generating a sound by releasing air from the sound-generating chamber in response to a threshold air pressure generated within the sound-generating chamber. Also, the air exhaust can be structured and positioned at a location on the whistle body for directing air flow away from the air exhaust in a generally downwardly direction with respect to a generally horizontal air flow direction at the air inlet.

The sound-generating chamber may comprise a generally cylindrical tube extending from its corresponding channel to its corresponding air exhaust. The sound-generating chamber may define a volumetric space formed with boundaries at: a plane of fluid communication interface between the chamber and its corresponding channel, and a plane of fluid communication interface between the chamber and its corresponding air exhaust. The air exhaust may be structured and positioned at a location on the whistle body for directing air flow away from the air exhaust in a generally opposing direction with respect to the generally horizontal air flow direction at the inlet. The body portion of the whistle may be comprised of a plastic material, a metal material, a wood material, or a composite material. In certain embodiments, an oral grip may be positioned adjacent to the air inlet of the whistle and configured for receiving and interfacing with a mouth or lips of a user thereon. The body portion of the whistle may also include a separate cavity which is not in fluid communication with the sound-generating chamber and which is provided to add bulk to the whistle body to facilitate ease of handling by a user, for example. In other embodiments, a separate and removable external cover positioned to cover at least a portion of the whistle body.

In various embodiments, a whistle shield apparatus can be structured for use in connection with a whistle including a whistle body having an air inlet in communication with an air exhaust. The shield apparatus may include a roof portion structured for receiving and maintaining the whistle body of the whistle therein and structured for covering the air exhaust of the whistle. The shield apparatus may further include a first cover portion contiguous with the roof portion and structured for directing at least a portion of air exiting the air exhaust in a generally downward direction with respect to a horizontal axis of the whistle body; and a second cover portion contiguous with the roof portion and structured for directing at least a portion of air exiting the air exhaust in a generally downward direction with respect to a horizontal axis of the whistle body. The roof portion, the first cover portion, and the second cover portion may comprise a flexible material. Also, the roof portion can be structured to be detachable from the whistle body of the whistle.

BRIEF DESCRIPTION OF THE DRAWINGS

FIG. 19B-1 includes a sectional view of FIG. 19B taken from the viewpoint at A-A.

FIG. 31 includes a table including an experimental design matrix for the experimental setup of FIG. 30.

FIG. 32 includes a table summarizing average sound level Observations associated with the experimental setup of FIG. 30.

FIG. 33 includes a table summarizing sound level and volume comparison for the experimental setup of FIG. 30.

DESCRIPTION

In various embodiments of the present invention, whistle devices and whistle-related structures are provided with enhanced features and technology that can promote the hygienic use of a whistle, while reducing the amount of air pressure needed for generating sound from the whistle.

Figure 1:
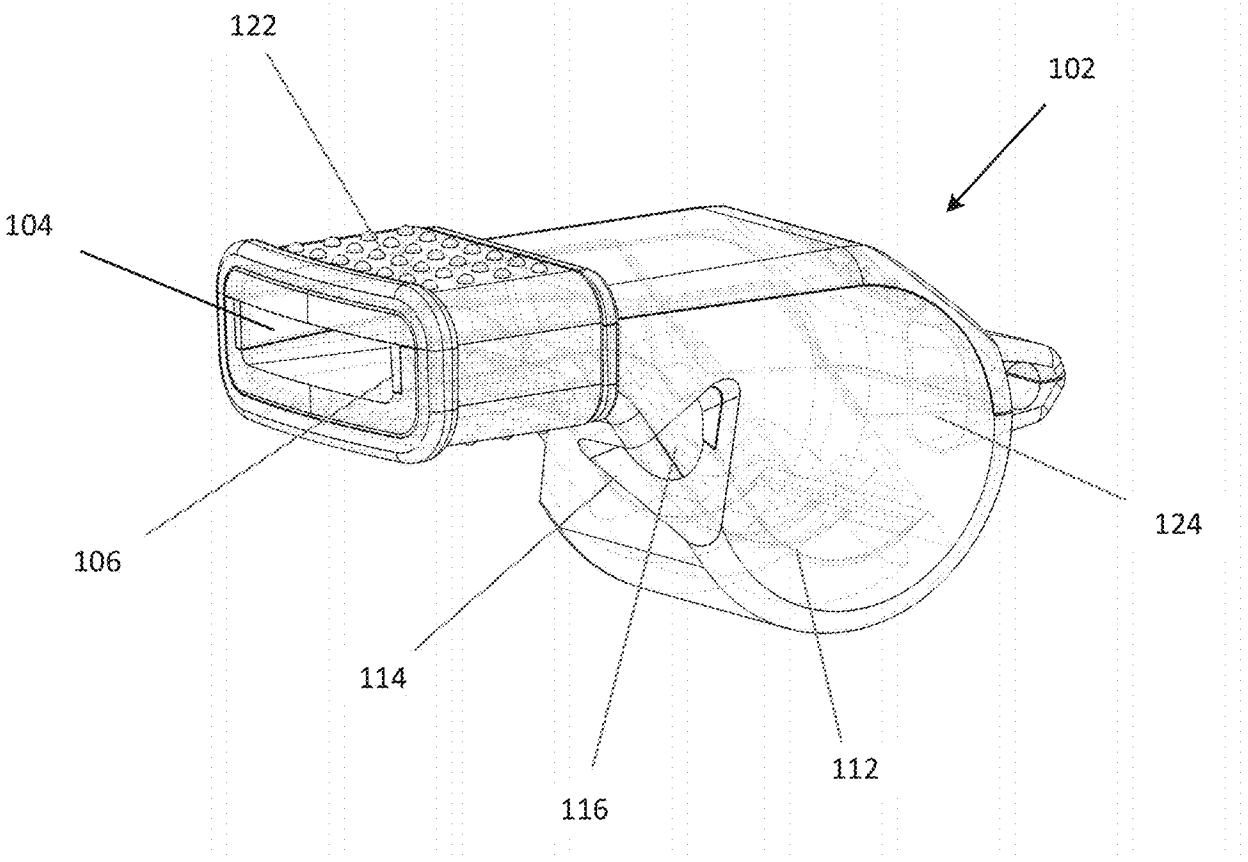
FIG. 1 includes a three-dimensional view depicting one example of a whistle structured in accordance with certain embodiments of the present invention.
Figure 2B:
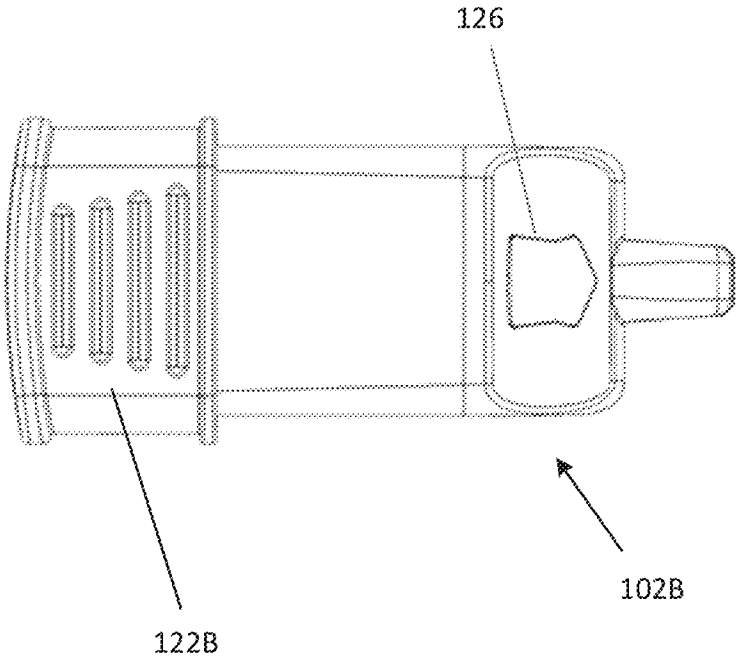
FIG. 2B illustrates a side elevational view of another example of a structured in accordance with certain embodiments of the present invention.
Figure 2A:
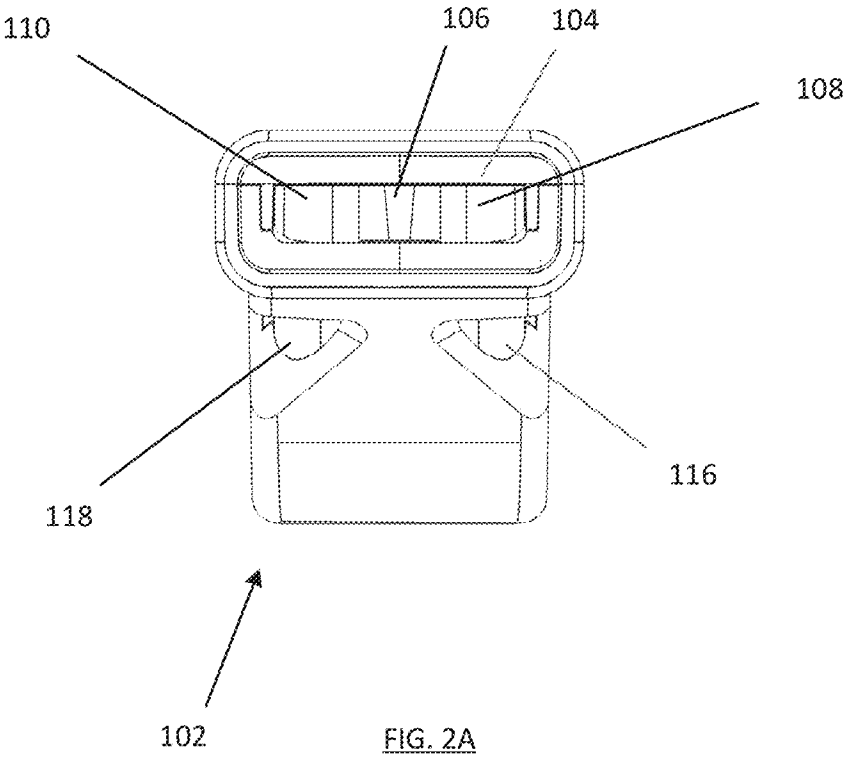
FIG. 2A depicts a front elevational view of the whistle of FIG. 1.
Figure 3:
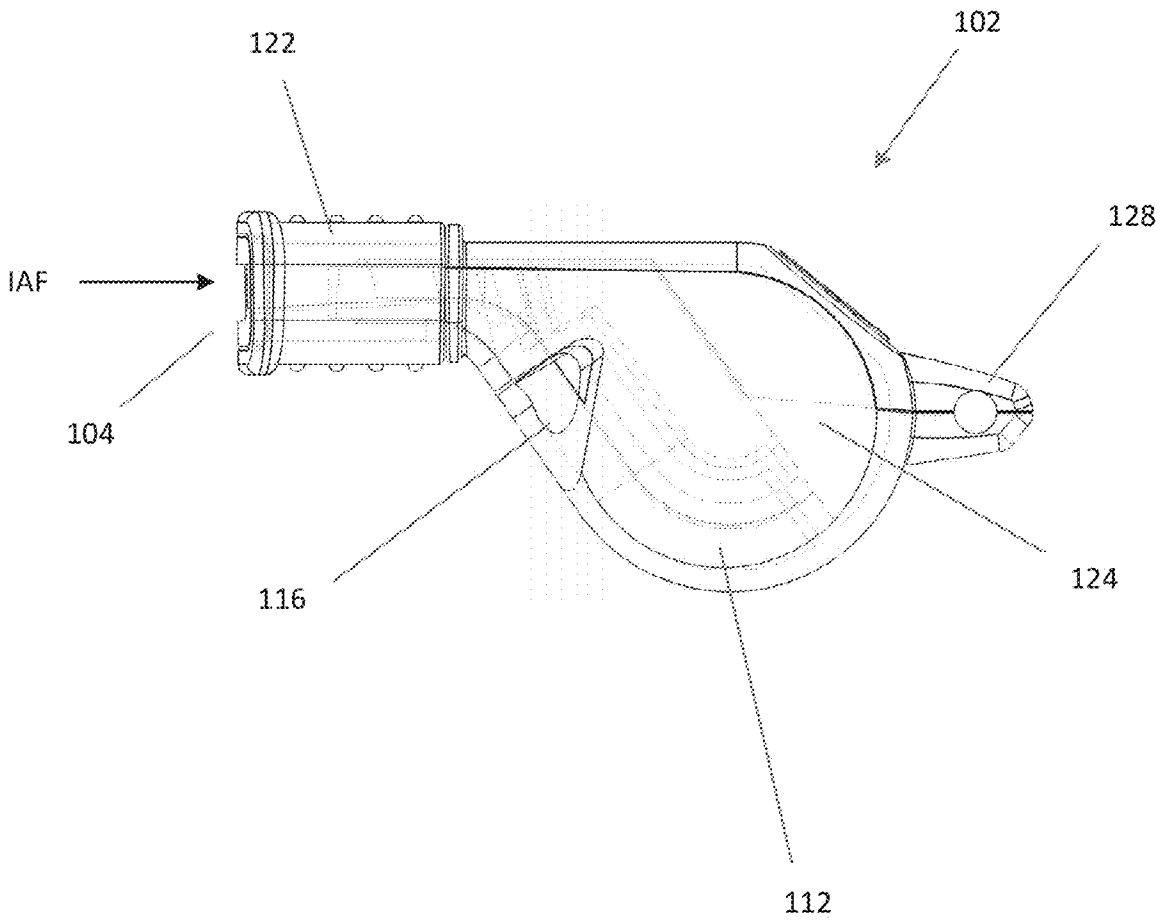
FIG. 3 illustrates a side elevational view of the whistle of FIG. 1.
Figure 4:
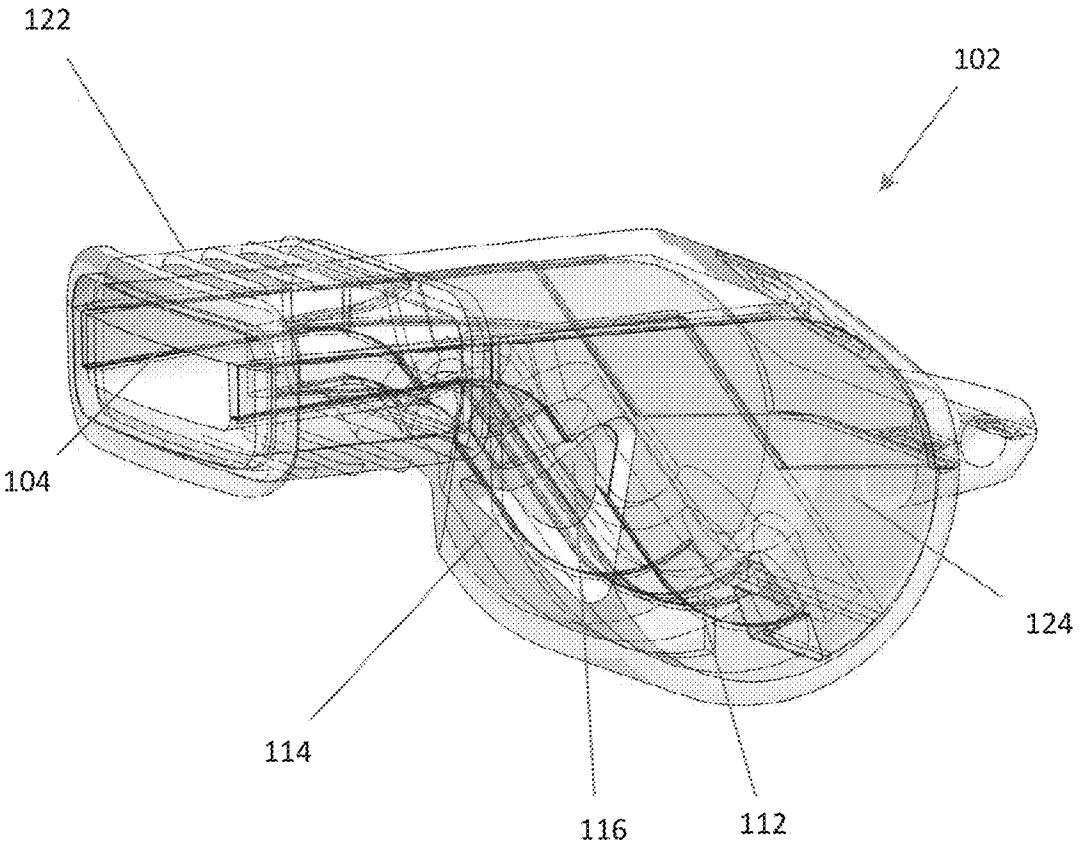
FIG. 4 illustrates a transparent three-dimensional view of the whistle of FIG. 1.
Figure 5:
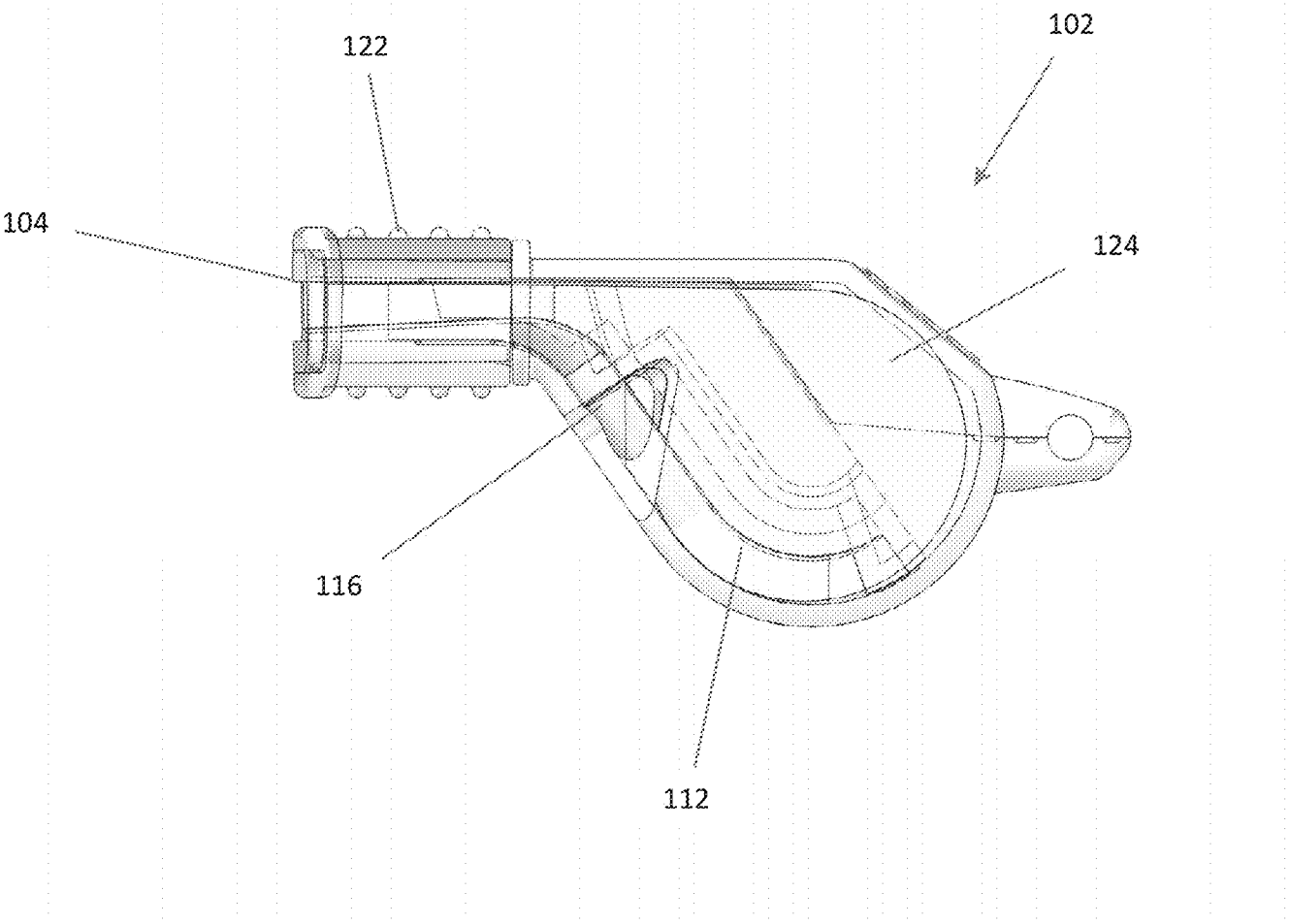
FIG. 5 illustrates a transparent side elevational view of the whistle of FIG. 1.
Figure 6:
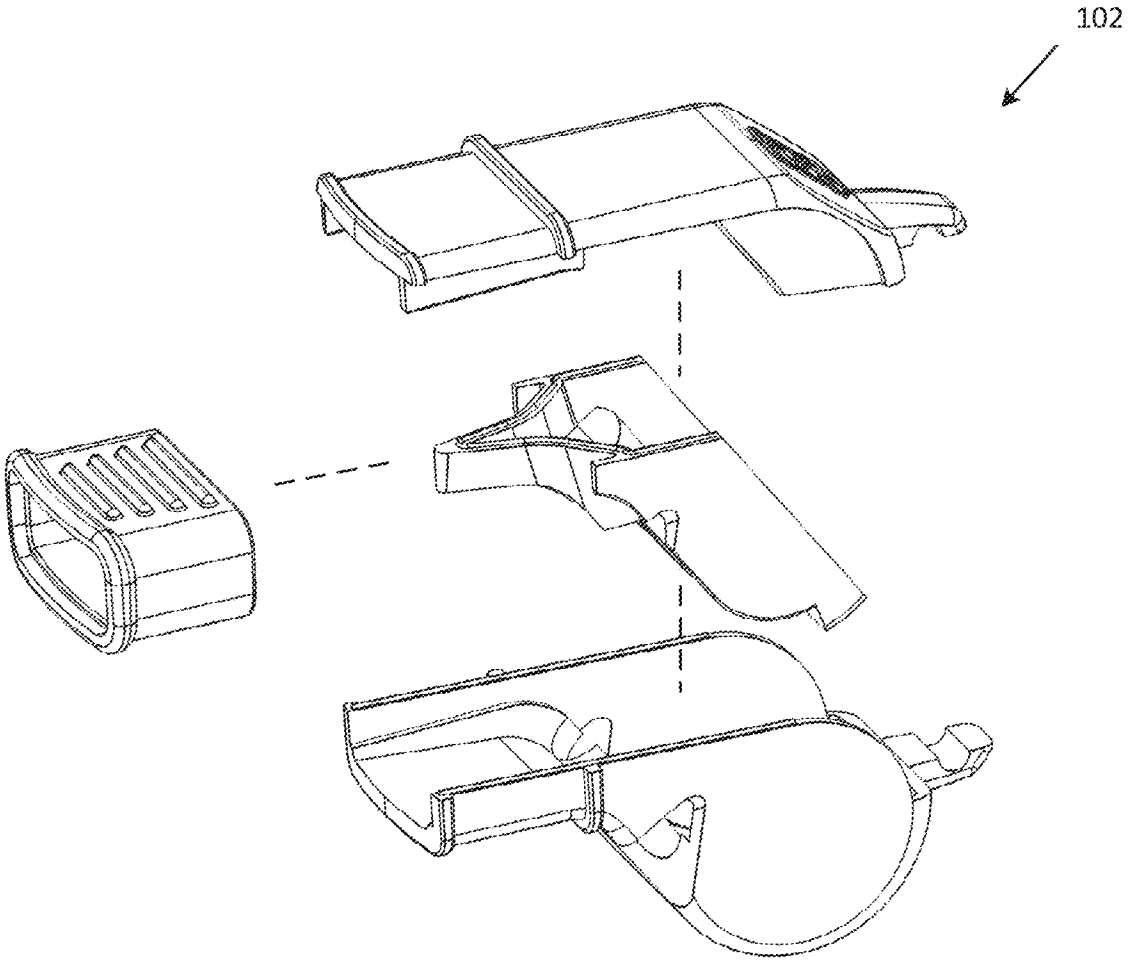
FIG. 6 depicts a three-dimensional exploded and disassembled view of the whistle of FIG. 1.

FIGS. 1 through 5 include various views depicting one example of a whistle 102 structured in accordance with certain embodiments of the present invention. In this example, the whistle 102 includes an air inlet 104 for receiving air supplied by a source of air pressure to the inlet 104. For example, a human user may breathe air into the inlet 104, or an air compressor apparatus may provide air flow, to provide an air supply to the whistle 102 through the inlet 104 at a suitable air pressure. FIG. 6 depicts a three-dimensional exploded and disassembled view of the whistle of FIG. 1.

In certain embodiments, a channelizer 106 may be provided in fluid communication with the inlet 104. The channelizer 106 may be provided as a generally triangular structure, for example, configured for dividing the air flow through at least two channels 108, 110, as shown, and for directing air flow to one or both sound-generating chambers 112, 114. Each chamber 112, 114 may be in fluid communication with the channelizer 106 and structured for receiving air flow from each corresponding channel 108, 110. In this example, each chamber 112, 114 comprises a generally cylindrical tube extending from its respective corresponding channel 108, 110 to a corresponding air exhaust 116, 118 positioned on each side of the outer body portion of the whistle 102.

Figure 7:
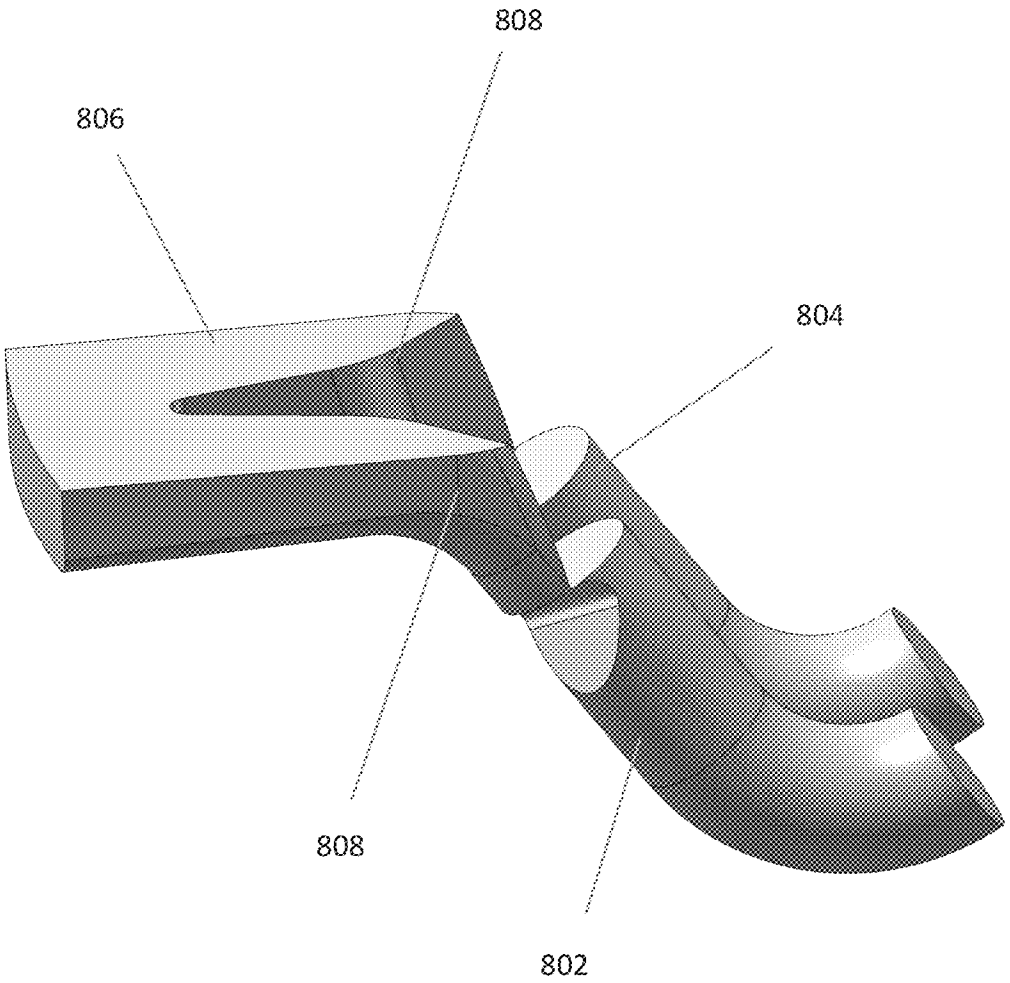
FIGS. 7 and 8 illustrate solid three-dimensional models of certain volumetric spaces contained within the whistle.
Figure 8:
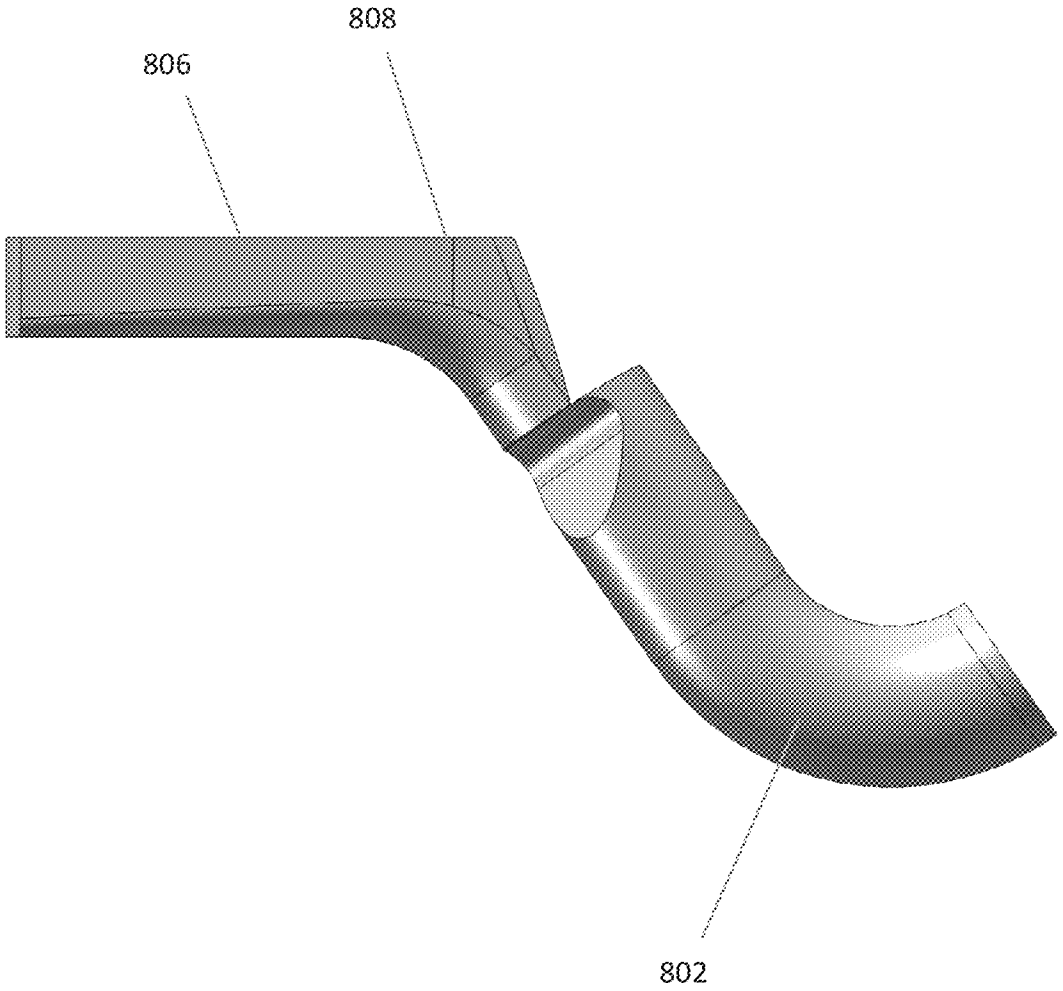
Figure 9A:
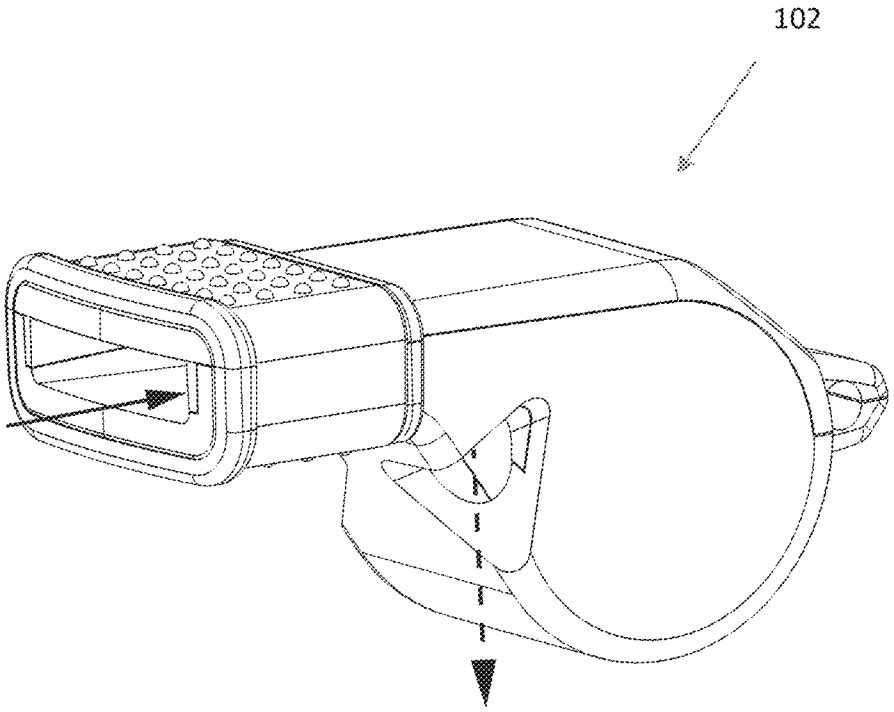
FIGS. 9A through 9D illustrate various views of the whistle of FIG. 1 schematically depicting air flowing through and/or exiting from the whistle.
Figure 9B:
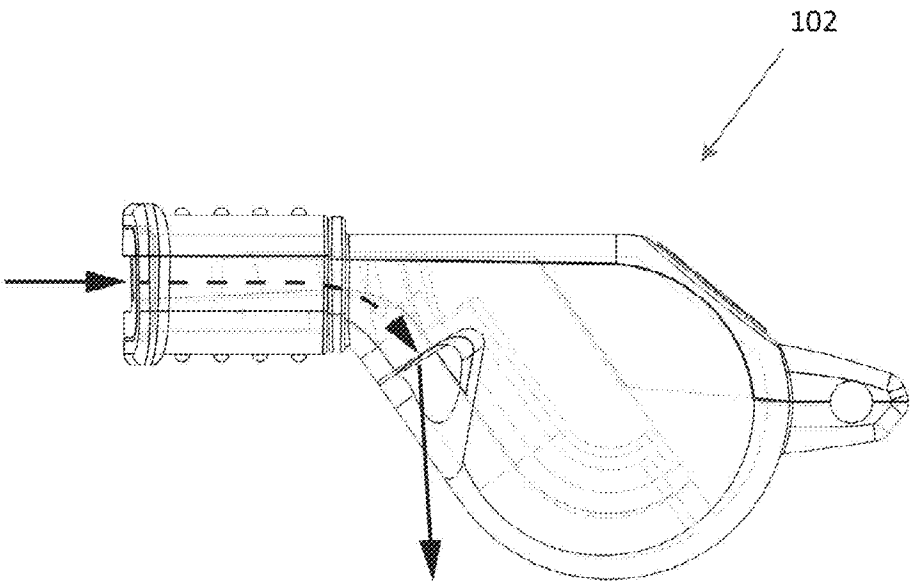
Figure 9C:
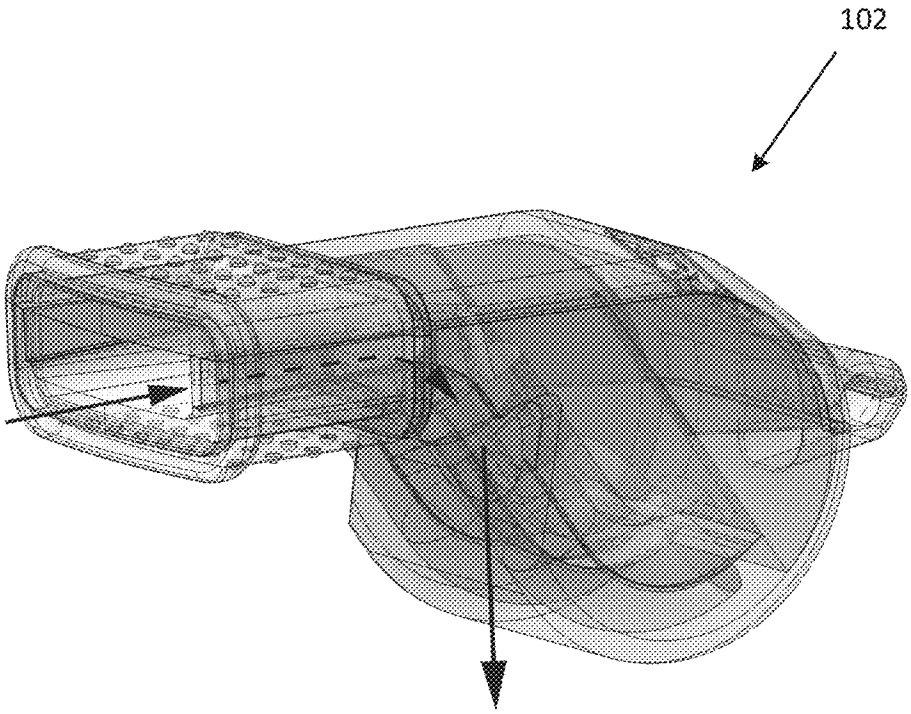
Figure 9D:
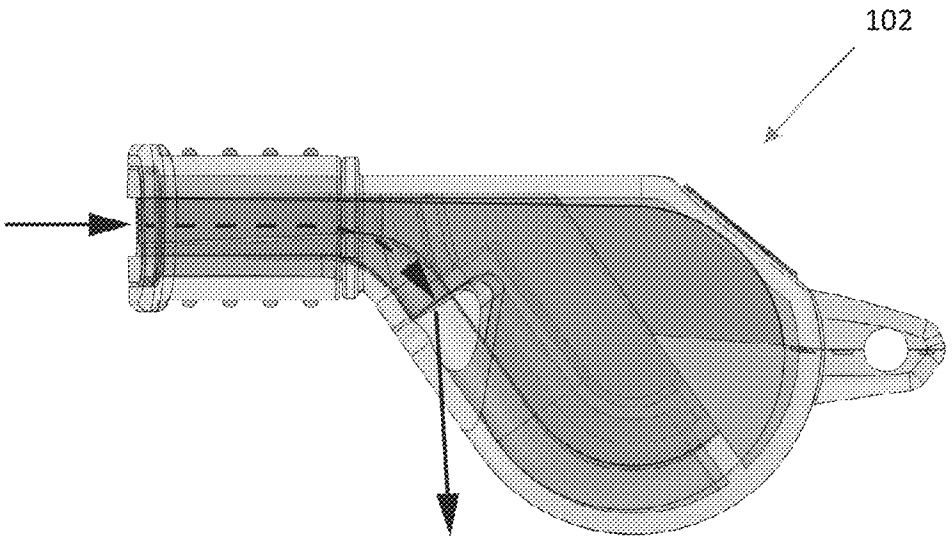

It can be appreciated that the volumetric space defined by one or both of the sound-generating chambers 112, 114 can be structured to provide an effective sound-generating capability of the whistle 102, while reducing the amount of air flow required at the inlet 104 of the whistle 102 to generate sound. A volume for this volumetric space may be calculated as the volumetric space bounded by a plane of fluid communication interface between the chamber 112, 114 and its corresponding channel 108, 110; and a plane of fluid communication interface between the chamber 112, 114 and its corresponding air exhaust 116, 118, as well as the physical structure of the chamber 112, 114 itself. FIGS. 6 and 7 illustrate, merely for convenience of illustration, solid three-dimensional models of the volumetric spaces contained within the whistle 102. Volume 802 represents the volumetric space contained within chamber 112, and volume 804 represents the volumetric space contained within sound-generating chamber 114. Volume 806 represents the volumetric space contained within the inlet 104 of the whistle 102. Boundary 808 represents the interface between the volumetric spaces 802, 806 and the interface between the volumetric spaces 804, 806. In various embodiment, a volume of each volumetric space 802, 804 can be in the range of 1,300 $mm^3$ to 1,500 $mm^3$, or more preferably in the range of 1,350 $mm^3$ to 1,400 $mm^3$. It can be appreciated that this reduction in the volumetric space 802, 804 necessary to produce an effective quality of sound from the whistle 102 can be beneficial to users suffering from breathing conditions (e.g., asthma) who require less air pressure to generate such sound in comparison to prior whistle designs.

During use and effective functioning of the whistle 102, as the air flow reaches one or both of the sound chambers 112, 114, air molecules begin to compress and form high-pressure regions within the sound-generating chambers 112, 114. When the air pressure within these high-pressure regions reaches a threshold level, the air escapes and flows through one or both of the air exhausts 116, 118. This escaping air flow produces the sound-generating effect of the whistle 102. In this example, the air exhausts 116, 118 are structured and positioned in a manner that directs air flow out of the whistle 102 in a generally downward direction (as shown more particularly by the representative air flow arrows depicted in FIGS. 9A through 9D). This can promote directing potentially harmful aerosol droplets, viruses, bacteria, air-borne pathogens, or other contaminants contained in the air outflow exiting from the air exhausts 116, 118 in a generally downwardly direction with respect to a generally horizontal inlet air flow direction IAF associated with the whistle 102 receiving air and air pressure at the inlet 104. In certain embodiments, the air exhausts 116, 118 can be further structured to promote directing air outflow from the air exhausts 116, 118 in a generally opposing direction with respect to the generally horizontal air flow direction IAF at the inlet 104. In other embodiments, the air exhausts 116, 118 can be further structured to promote directing air outflow from the air exhausts 116, 118 both in a generally opposing direction and generally downwardly with respect to the generally horizontal air flow direction IAF at the inlet 104.

Those skilled in the art can appreciate that the frequency of the sound emanating from the whistle 102, among other sound characteristics, depends on the geometry of the whistle 102, including the structure of the sound-generating chambers 112, 114, for example. In certain embodiments, these sound characteristics can be altered or impacted by use of different materials comprising the whistle 102, such as plastic, metal (e.g., steel, stainless steel, brass), wood, or composite materials, for example. For example, a metal whistle 102 can typically deliver a louder sound than a whistle made from other materials, such as plastic, which can deaden the sound. In another example, a whistle 102 comprising a material such as brass can amplify the sound effect, while maintaining improved resonance and sound quality and providing durability and an extended useful life for the whistle 102.

In certain embodiments, the whistle 102 can be structured to include various kinds of oral grips, such as grips 122, 122B, which can be configured for receiving and interfacing with a mouth or lips of a user to facilitate proper seating and application of air pressure to the whistle 102 during use. In other embodiments, a body portion 124 of the whistle 102 may be provided as a separate cavity which is not in fluid communication with the sound-generating chambers 112, 114, and which serves to provide bulk to the whistle 102. The bulk provided by this body portion 124 can facilitate ease of handling and use of the whistle 102 by a human operator, for example, who is manually gripping and using the whistle 102. In other aspects, and with reference to the example shown in FIG. 2B, various kinds of insignia 126 may be formed in the body of a whistle 102B, for example, perhaps to signify an organization or other affiliation of the user. In another example, an attachment structure 128 may be formed in the whistle 102, such as to attach the whistle 102 to a lanyard, a loop of string or rope, or another point of attachment.

Figure 10A:
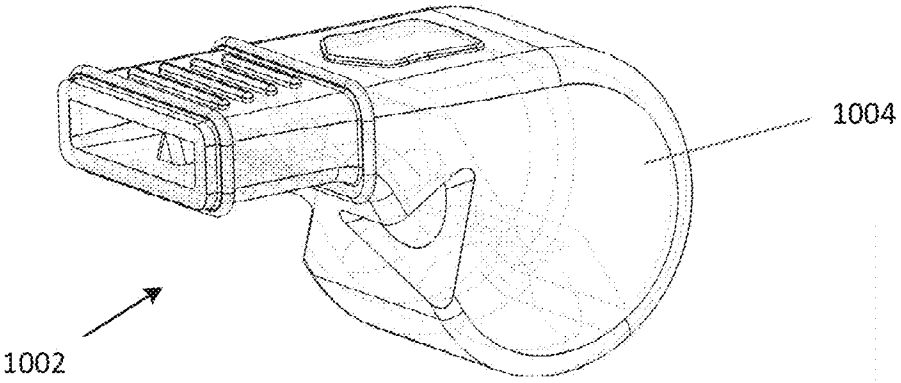
FIGS. 10A through 10C illustrate different views of one example of a whistle structured in accordance with certain embodiments of the invention.
Figure 10B:
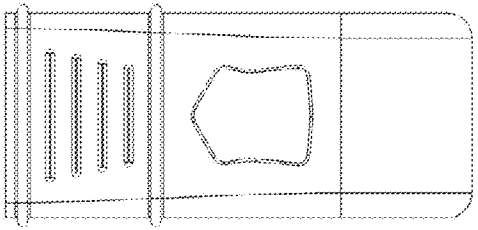
Figure 10C:
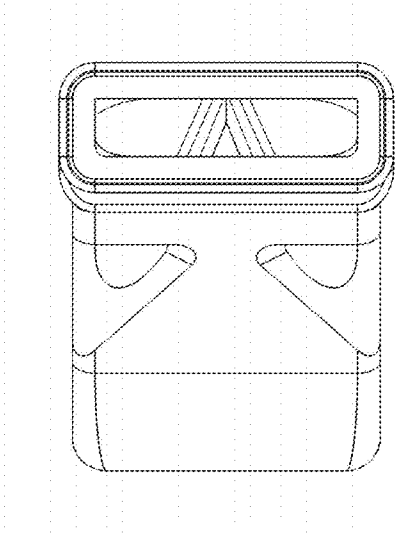
Figures 11A, 11B:
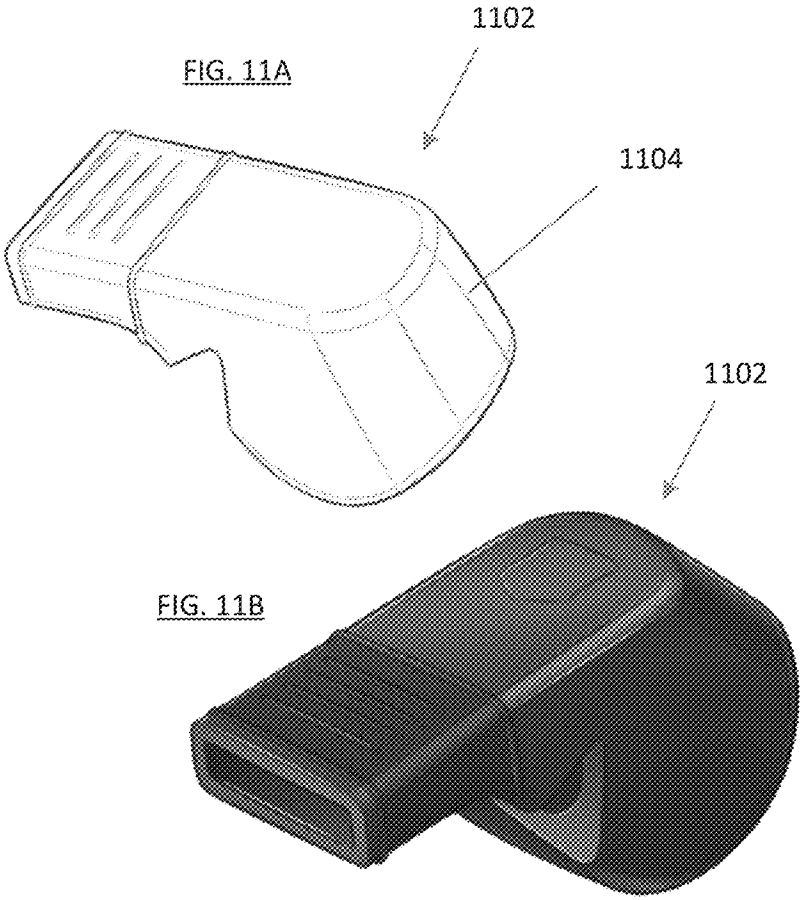
FIGS. 11A and 11B illustrate different views of one example of a whistle structured in accordance with certain embodiments of the invention.

In other embodiments of the invention, an example of a whistle 1002 is shown in FIGS. 10A through 10C, which has a body portion 1004 with a standard cavity size. Also, as shown in FIGS. 11A and 11B, an example of a whistle 1102 is shown which has a body portion 1104 with a reduced cavity size having a curvature around the outside shape of the whistle 1102.

Figure 13A:
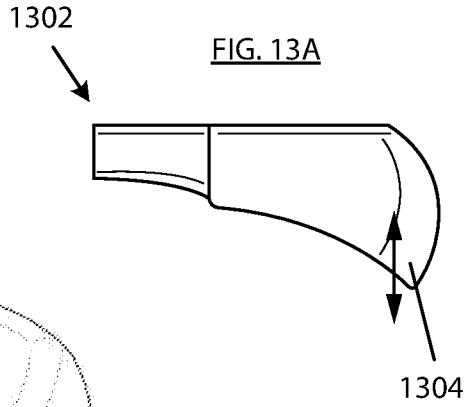
FIGS. 13A through 13C illustrate different views of one example of a whistle structured in accordance with certain embodiments of the invention.
Figure 13B:
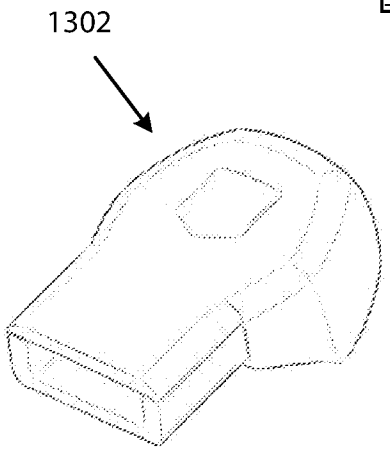
Figure 13C:
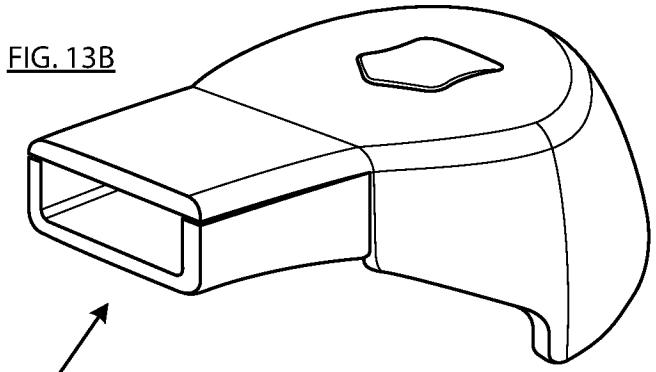
Figure 12A:
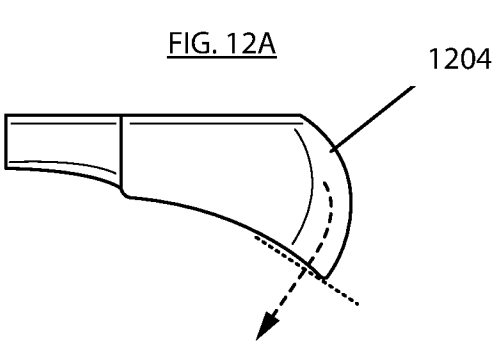
FIGS. 12A through 12C illustrate different views of one example of a whistle structured in accordance with certain embodiments of the invention.
Figure 12B:
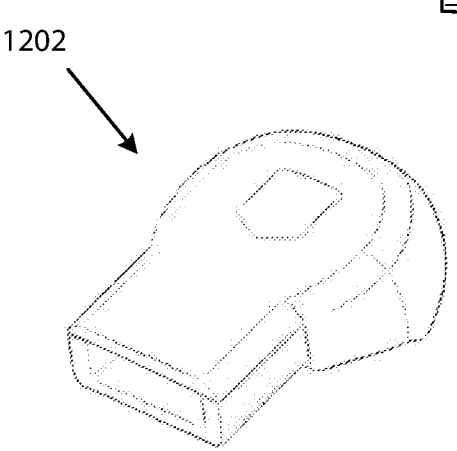
Figure 12C:
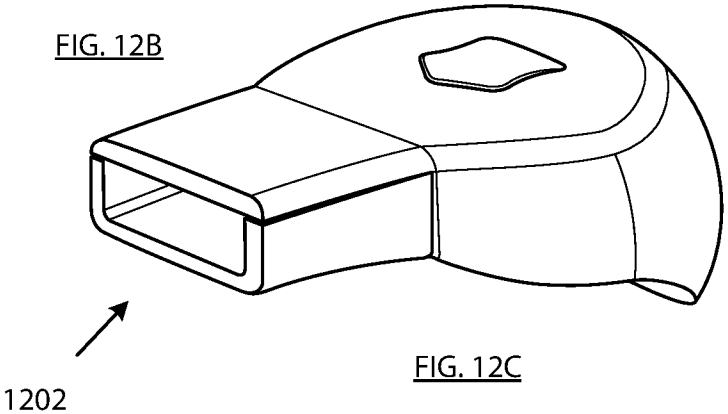

In other embodiments of the invention, with respect to an example of a whistle 1202 shown in FIGS. 12A through 12C, a body portion 1204 of the whistle 1202 can be structured in a manner that reduces exhaust air flow directly back toward a user. With regard to another example of a whistle 1302 shown in FIGS. 13A through 13C, a rear wall portion of a body portion 1304 of the whistle 1302 can be flared outward to reduce the possibility of undercuts performed during manufacturing or production of the whistle 1302. The bi-directional arrow in FIG. 13A represents the direction of movement of tool, for example, which might be used to form the whistle 1302.

Figure 15A:
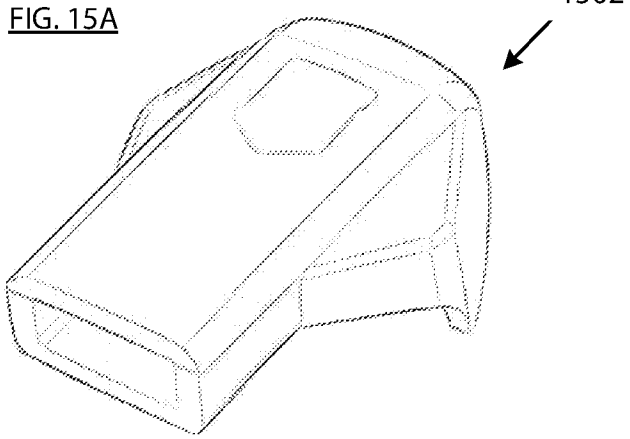
FIGS. 15A and 15B illustrate different views of one example of a whistle structured in accordance with certain embodiments of the invention.
Figure 15B:
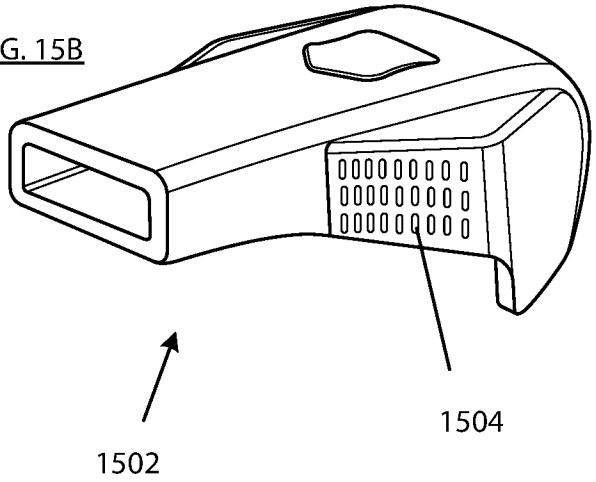
Figure 14A:
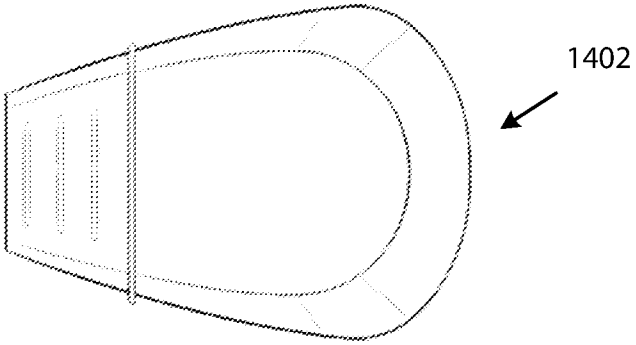
FIGS. 14A and 14B illustrate different views of one example of a whistle structured in accordance with certain embodiments of the invention.
Figure 14B:
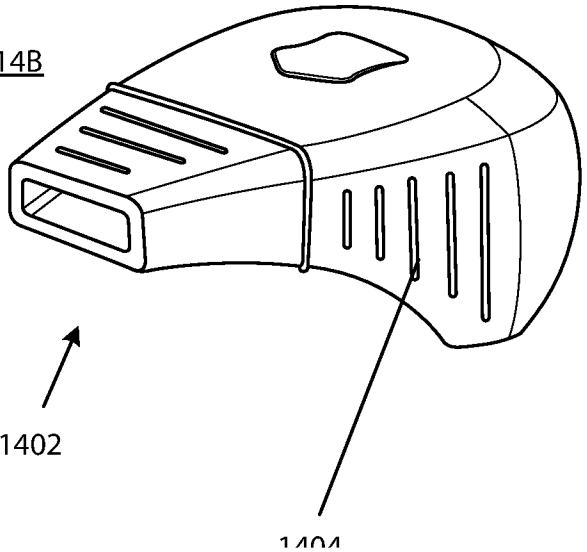

In other embodiments, and with respect to an example of a whistle 1402 shown in FIGS. 14A and 14B, a body portion 1404 of the whistle 1402 can be flared outward in a rounded manner that provides a shielding and directional effect (e.g., generally downwardly) for air exhaust exiting the whistle 1402. In another example shown in FIGS. 15A and 15B, a whistle 1502 includes a body portion 1504 embodying a generally triangular structure which provides a shielding and directional effect (e.g., generally downwardly) for air exhaust exiting the whistle 1502.

Figure 17A:
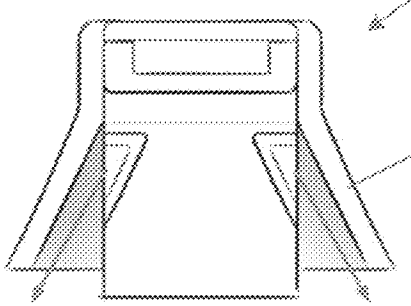
FIGS. 17A and 17B illustrate different views of one example of a whistle structured in accordance with certain embodiments of the invention.
Figure 17B:
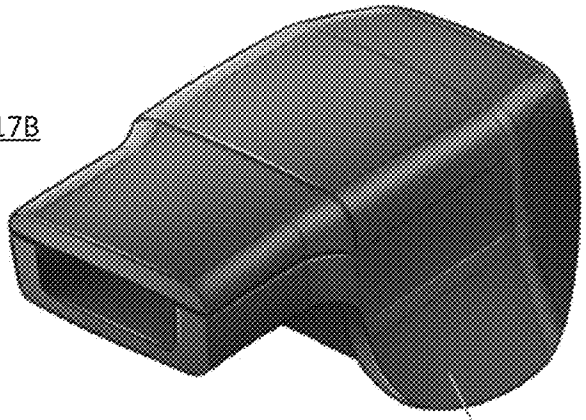
Figure 16A:
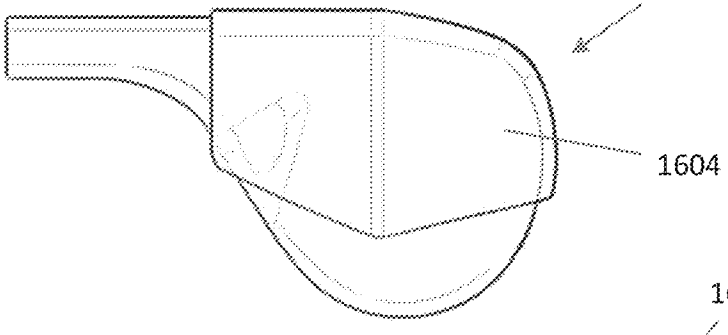
FIGS. 16A and 16B illustrate different views of one example of a whistle structured in accordance with certain embodiments of the invention.
Figure 16B:
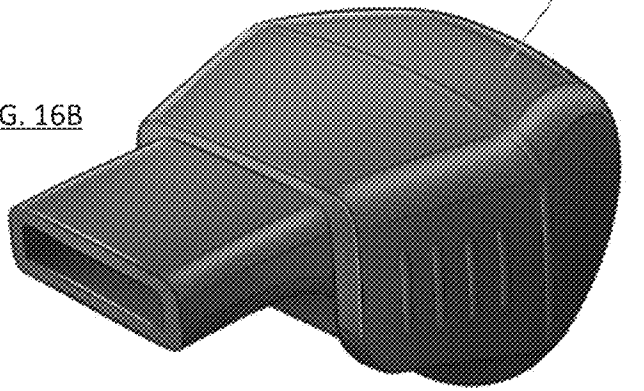
Figure 18A:
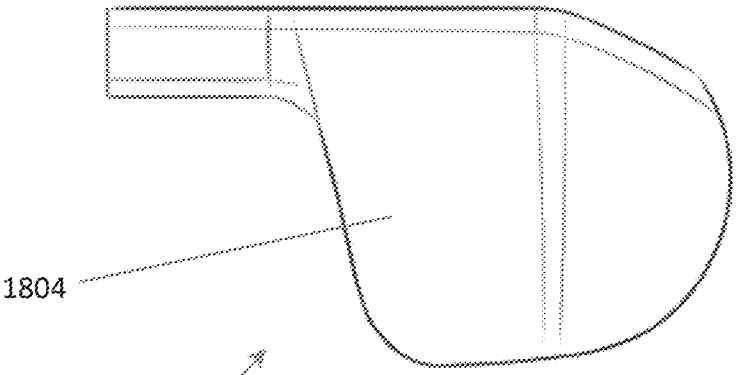
FIGS. 18A and 18B illustrate different views of one example of a whistle structured in accordance with certain embodiments of the invention.
Figure 18B:
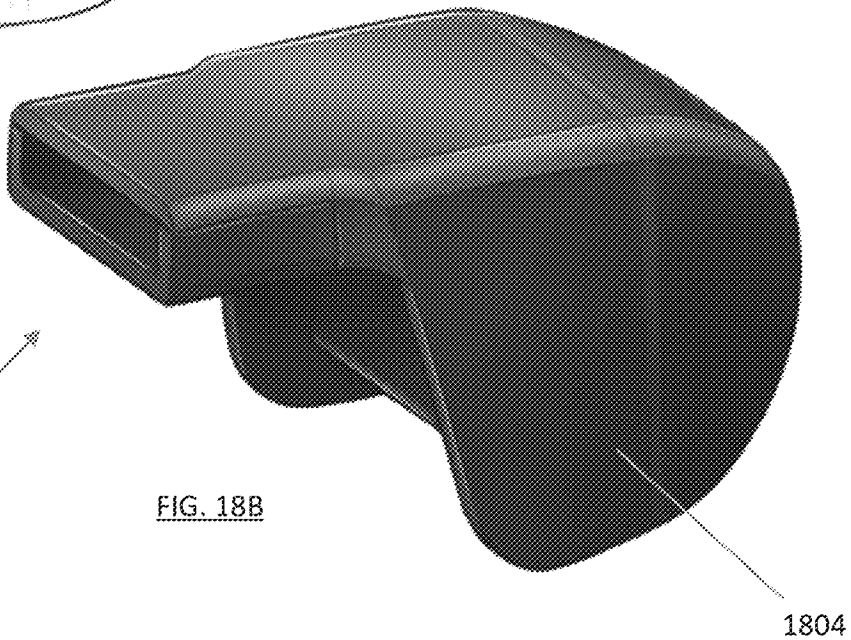
Figure 19E:
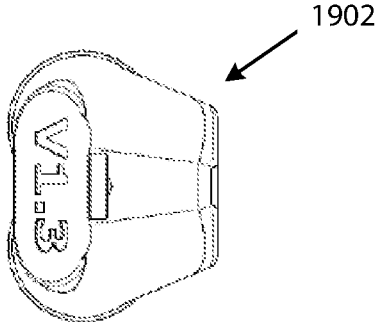
FIG. 19E is a top elevational view of the whistle shield of FIG. 19A.
Figure 19A:
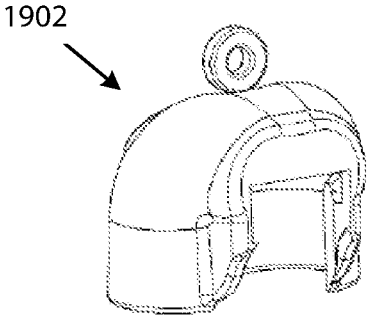
FIG. 19A includes a three-dimensional illustration of one example of a whistle shield structured in accordance with certain embodiments of the invention.
Figure 19C:
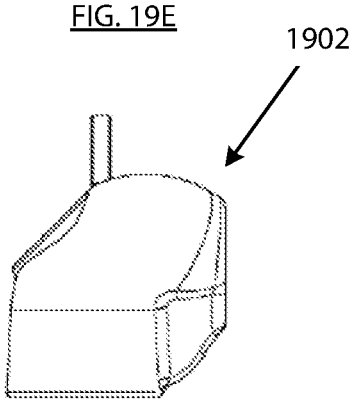
FIG. 19C is a side elevational view of the whistle shield of FIG. 19A.
Figure 19B:
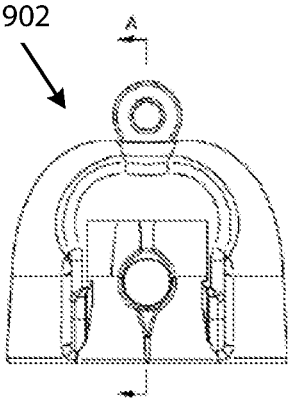
FIG. 19B depicts a front elevational view of the whistle shield of FIG. 19A.
Figures 1, 19B:
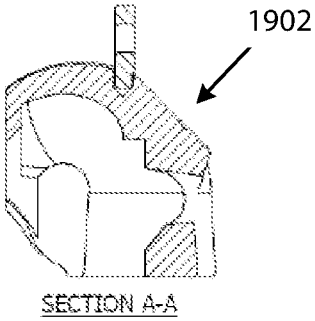
Figure 19D:
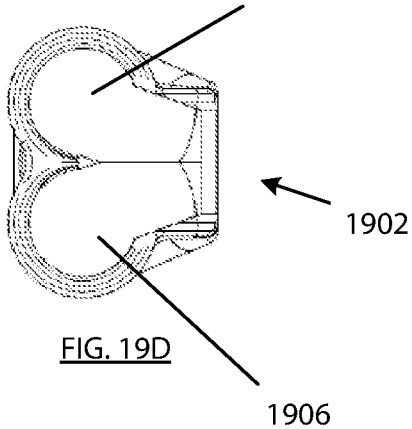
FIG. 19D is a bottom elevational view of the whistle shield of FIG. 19A.

In other embodiments, and with respect to an example of a whistle 1602 shown in FIGS. 16A and 16B, a separate and removable external cover 1604 can be installed onto a whistle 102 (as described above) to form the composite whistle 1602 and to provide a shielding and directional effect (e.g., generally downwardly) for air exhaust exiting the whistle 1602. In another example shown in FIGS. 17A and 17B, a separate and removable external cover 1704 can be installed onto a whistle 102. (as described above) to form a composite whistle 1702 and to provide a shielding and directional effect (e.g., generally downwardly) for air exhaust exiting the whistle 1702. In another example shown in FIGS. 18A and 18B, an external cover 1804 can be incorporated directly into a whistle 102 (as described above) to form a whistle 1802. It can be seen that the external cover 1804 provides a shielding and directional effect (e.g., generally downwardly) for air exhaust exiting the whistle 1802.

With reference to FIGS. 19A through 23, the present disclosure provides a whistle and/or whistle accessory which blocks aerosol particles from entering the air surrounding a whistle without noticeably or significantly affecting the sound or ease-of-use of the whistle. A whistle and whistle shield of the disclosure is thus convenient and easy to use and does not cause any distraction or extra effort on the part of the user. Accordingly, as one example, a referee can use the whistle and whistle shield during a sporting event safely with regard to aerosol sprays and can meet local safety and facemask requirements due to the COVID-19 pandemic seamlessly without the whistle being a distraction or affecting the referee's judgment. In certain embodiments, the disclosure provides a whistle and/or whistle accessory shield which easily clips onto, and off of, a whistle, and provides the above-mentioned hygienic benefits, and is convenient to detach, clean, and store.

The present disclosure provides a whistle shield 1902, 2102 that can be provided with a new whistle, as part of an entirely new whistle design, or can be provided separately (aftermarket) to be attached to an existing whistle 2002. In this example, an existing whistle is one manufactured by Fox 40 International Inc. (headquartered in Hamilton, Ontario, Canada). The whistle shield 1902 does not noticeably or materially impact the sound of the whistle 2002, The whistle shield 1902, 2102 effectively diverts aerosol particles and exhaust spray from emanating from the top and sides of the whistle.

Figure 22:
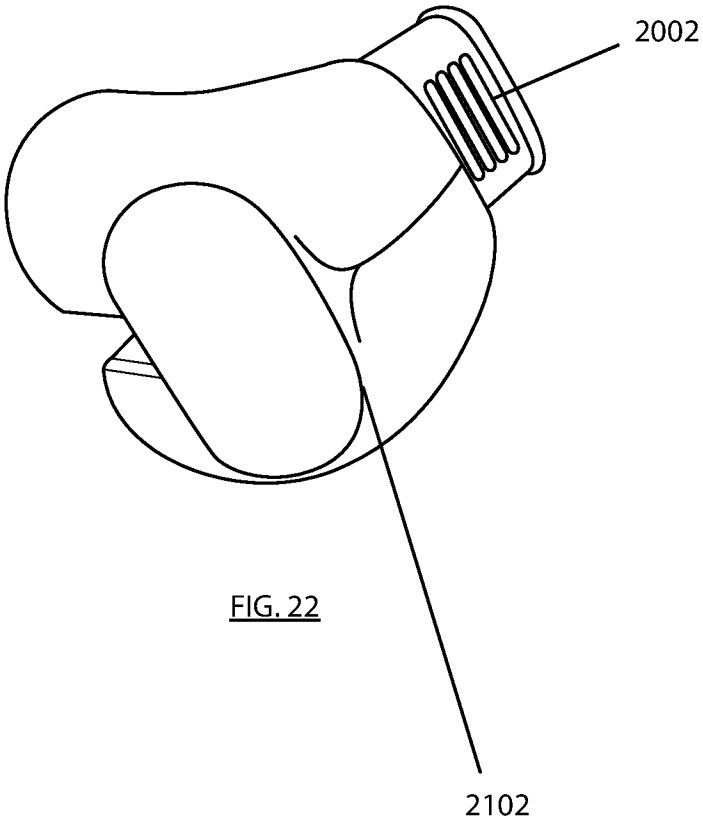
FIG. 22 depicts a three-dimensional view of a whistle shield structured in accordance with certain embodiments of the invention and in combination with the whistle shown in FIGS. 20A and 20B.
Figure 20A:
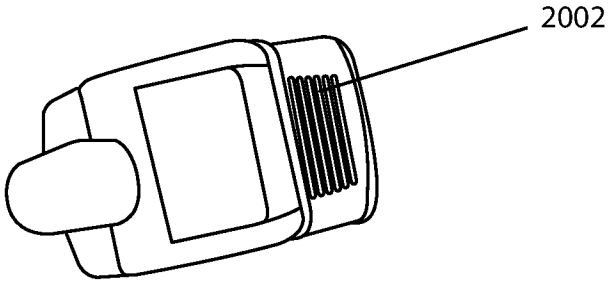
FIGS. 20A and 20B illustrate examples of existing prior art whistles which can be used in combination with certain features and aspects of various embodiments of the present invention.
Figure 21:
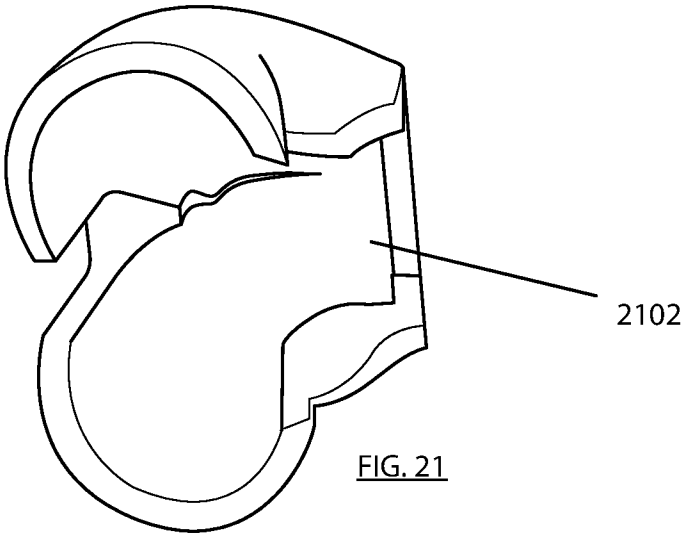
FIG. 21 depicts a three-dimensional view of a whistle shield structured in accordance with certain embodiments of the invention.
Figure 23:
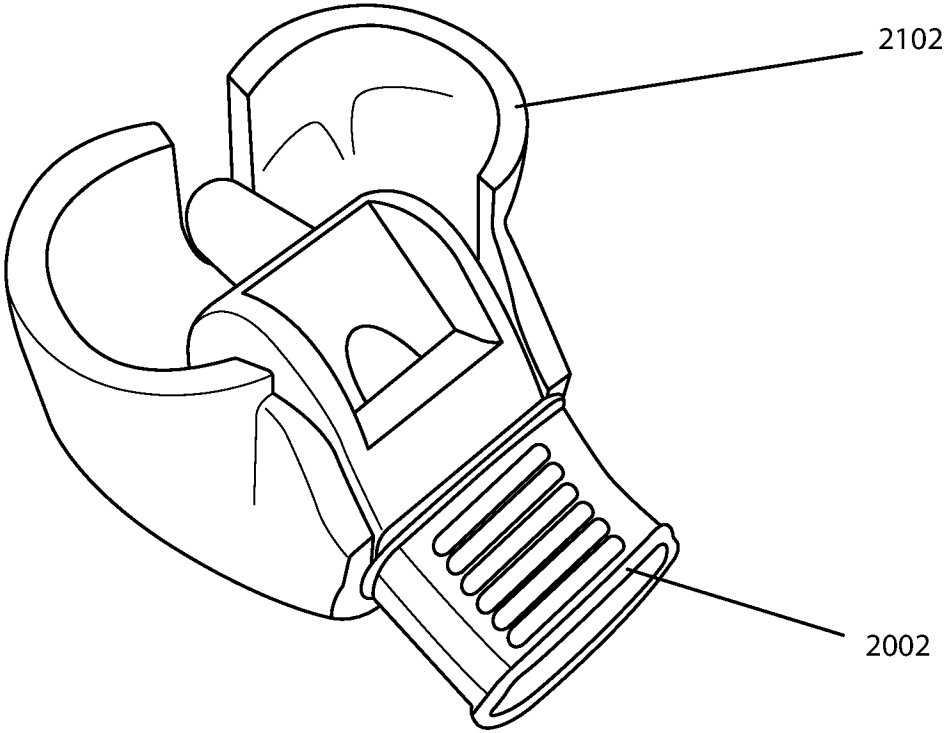
FIG. 23 depicts another three-dimensional view of the whistle and whistle shield combination as shown in FIG. 22.
Figure 20B:
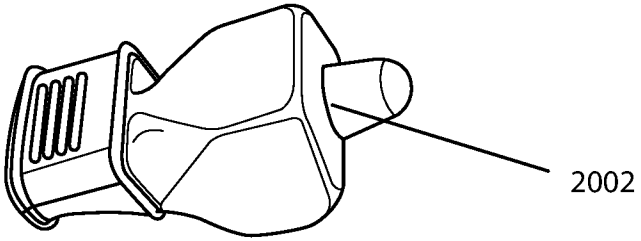

In one embodiment, the disclosure provides the whistle shield 1902, 2102 as an accessory which resembles a roof with cover portions 1904, 1906 for covering the whistle 2002 exhaust vent (e.g., see FIGS. 22 and 23). The accessory can be easily clipped on, or clipped off of, a whistle. The accessory blocks and/or diverts aerosol particles from emanating from the whistle when used. The accessory can be attached onto existing whistles like whistle 2002, and the accessory does not noticeably or materially impact the sound of the whistle. The accessory attaches easily to a wide variety in size, shape, and materials of existing whistles.

The shield 1902, 2102 may be provided in a variety of embodiments and may take different forms, e.g., solid, flat, rounded, tubed, and may have holes, which in embodiments may be small holes. The shield 1902, 2102 may be constructed of materials commonly used for whistles. This can include, for example, plastic, stainless steel, and/or composite materials, etc. In a preferred embodiment, the whistle shield accessory of the invention can be made from an antimicrobial plastic material. In preferred embodiments, the inventive product is made using an impenetrable, antimicrobial plastic material which does not necessarily need to be machine washed after use.

In certain embodiments, the whistle shield 1902, 2102 may be attached to a whistle 2002 via a clip, tether, or may snap or attach onto a whistle. Such attachment mechanisms allow the accessory to be attached to all types of whistle designs, e.g., of varying shapes and sizes and materials.

In various embodiments, the shield 1902, 2102 may be structured as an attachment which may snap or clip onto a whistle 2002 enabling a user, for example, a referee, to redirect exhaust aerosol droplets from the whistle 2002 downward (as opposed, for example, to upward and/or outward). Accordingly, in certain embodiments, the invention can be provided as an attachment which can be attached to existing whistles.

The effectiveness and usability of the whistle 2002 is not affected by the attached whistle shield 1902, 2102, and performance of the whistle 2002 (in comparison with not using the whistle shield 1902, 2102) is not affected. The whistle shield 1902, 2102 can be conveniently attached and detached allowing the whistle shield 1902, 2102 to be easily cleaned, stored, and available for next use. The disclosure provides a product which acts as a physical barrier to the whistle 2002 vent exhaust and which protects the user from physically touching the whistle. In embodiments, the shield 1902, 2102 includes a feature which can be attached to a user lanyard.

The shield 1902, 2102 also permits whistle-based timing systems to be used without upgrade or alteration, with the shield 1902, 2102 attached to a user's whistle. The attachment system, for example, may be built into the design of a product and snaps or clips directly into place. A variety of different materials can also be used, and a variety of aesthetic design shapes are contemplated.

Figure 24:
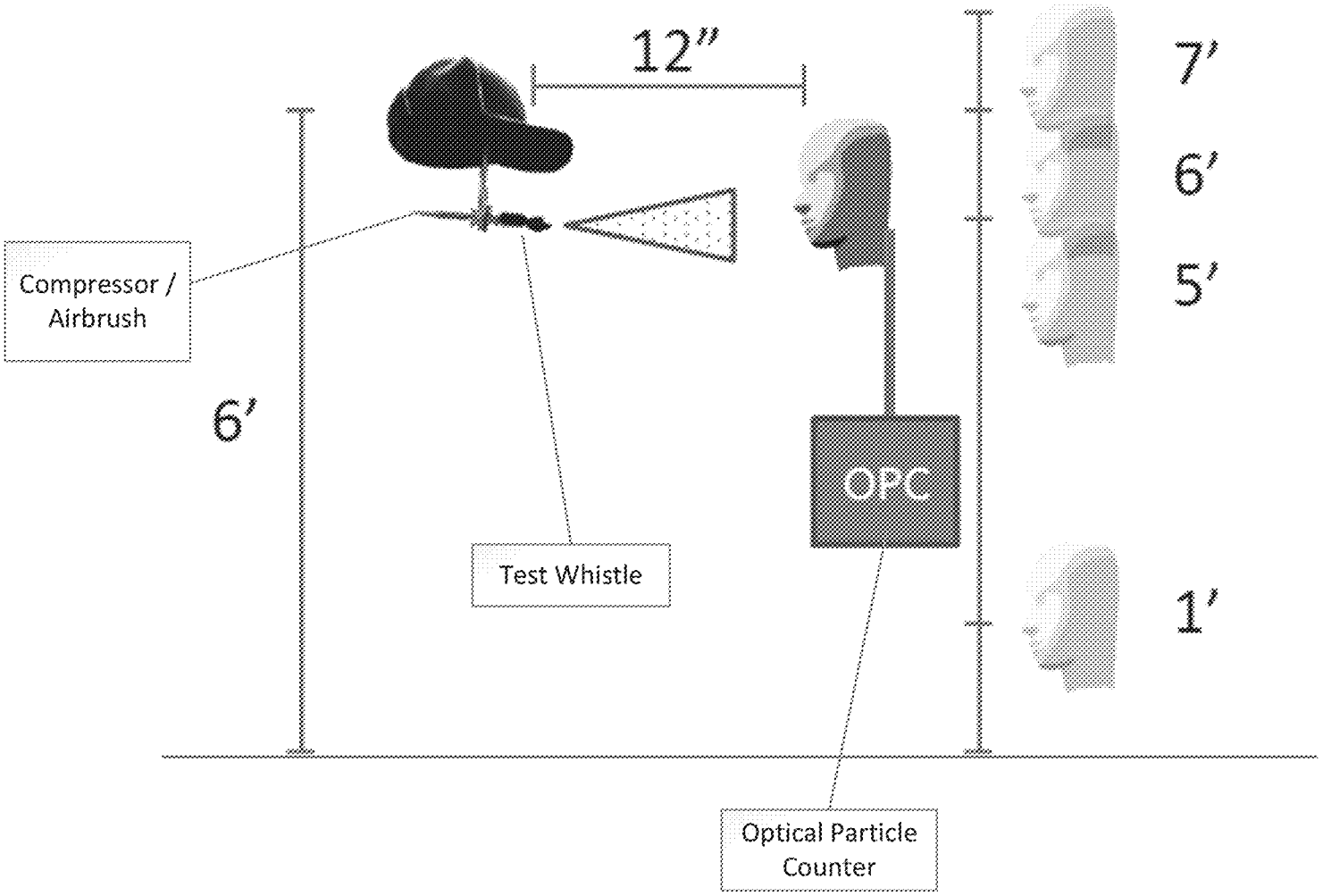
FIG. 24 schematically depicts an experimental setup involving a comparison of a whistle structured in accordance with embodiments of the invention described herein against an existing whistle design.

With reference to FIG. 24, an experimental test was performed to compare certain aspects of a whistle structured in accordance with the whistle 102 described herein against a whistle structured in accordance with the existing whistle 2002 described herein. The test involved assessing and comparing aerosol particulate concentrations in exhaust air generated by each whistle 102, 2002. The experimental plan included simulating droplet generation via artificial saliva expulsion through each whistle 102, 2002, and the test included an analysis of droplet exposure reduction under the specified testing conditions.

As shown in FIG. 24, droplet expulsion from the two whistle configurations was tested at four relative height differences between the simulated referee and athlete. Whistle airflow was provided by an external compressor/airbrush combination, with artificial saliva (DIN 53160, Pickering Laboratories) injected into the whistle stream. The test components were connected to the whistle with a custom 3D-printed adapter. Particulate characterization was conducted over the diameter range of 0.3-25 μm diameter using a TSI Aerotrak 9306 optical particle counter (OPC). Droplet mitigation was calculated as the percent reduction in particle concentration measured during use of the whistle 102 versus particle concentration measured during use of the existing whistle 2002. Testing was performed in a Class 1000 clean room (background particulates <10 #/cm3); the room was flushed with HEPA-filtered air between test iterations.

With respect to the experimental setup, a simulated referee was constructed using an airbrush and compressor connected to each whistle via a custom 3D printed TPU adapter. The simulated athlete was located 12" from the whistle, at relative heights equal to the referee, at 1' above and below the referee, and at 5' below the referee (1' from the ground). Testing at each height was conducted using each whistle 102, 2002. Six sampling iterations (10 seconds duration) were conducted for each configuration and height. Artificial saliva was injected into the airstream via the airbrush at three second intervals.

Figure 25:
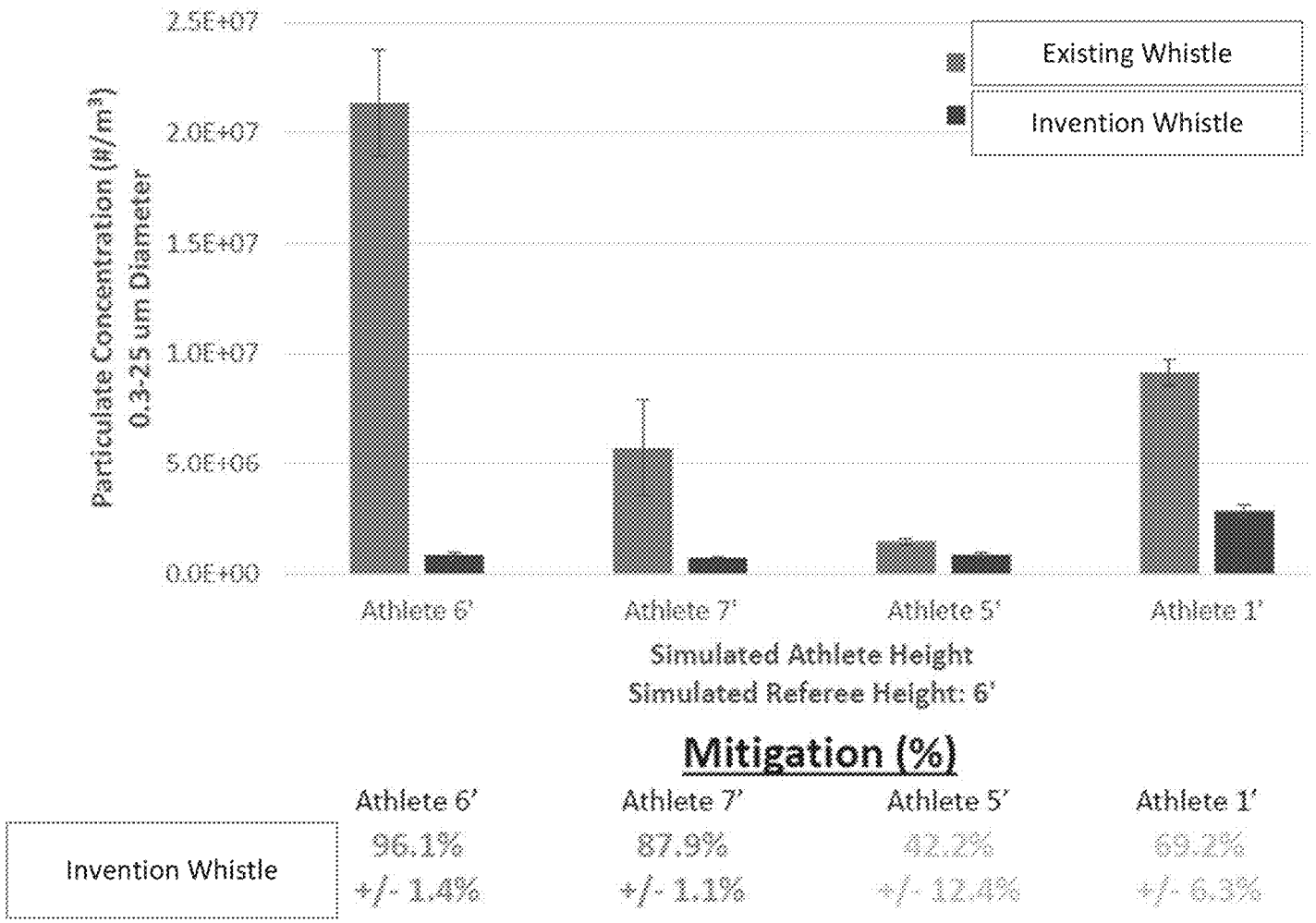
FIG. 25 includes a graphical representation of experimental results obtained from the experimental setup of FIG. 24.
Figure 26:
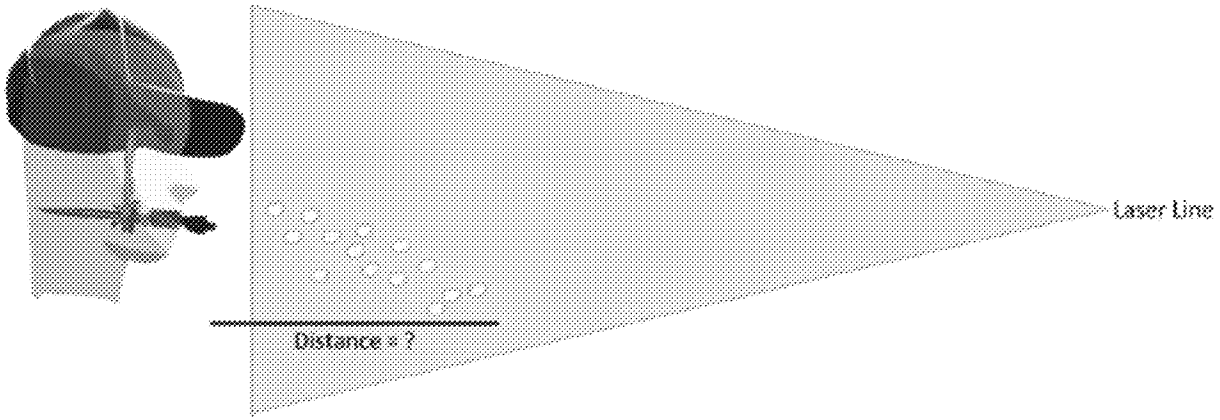
FIG. 26 schematically depicts another experimental setup involving a comparison of a whistle structured in accordance with embodiments of the invention described herein against an existing whistle design.

As shown in the graph of FIG. 25, with the whistle 102 highly reduced droplet concentrations at heights equivalent to or above the simulated referee at a horizontal distance of 1'. Also, the whistle 102 moderately reduced droplet concentrations at heights below that of the simulated referee at a horizontal distance of 1'. With respect to mitigation results, the whistle 102 reduced droplet concentrations by 87.9% to 96.1% when the simulated athlete was positioned at the same height or above the simulated referee. Also, the whistle 102 reduced droplet concentrations by 42.2% to 69.2% at heights below that of the simulated referee. Overall, the inventive whistle 102 performed better than the existing whistle 2002 at reducing droplet concentrations at all athlete heights in comparison to the existing whistle 2002.

Figure 27:
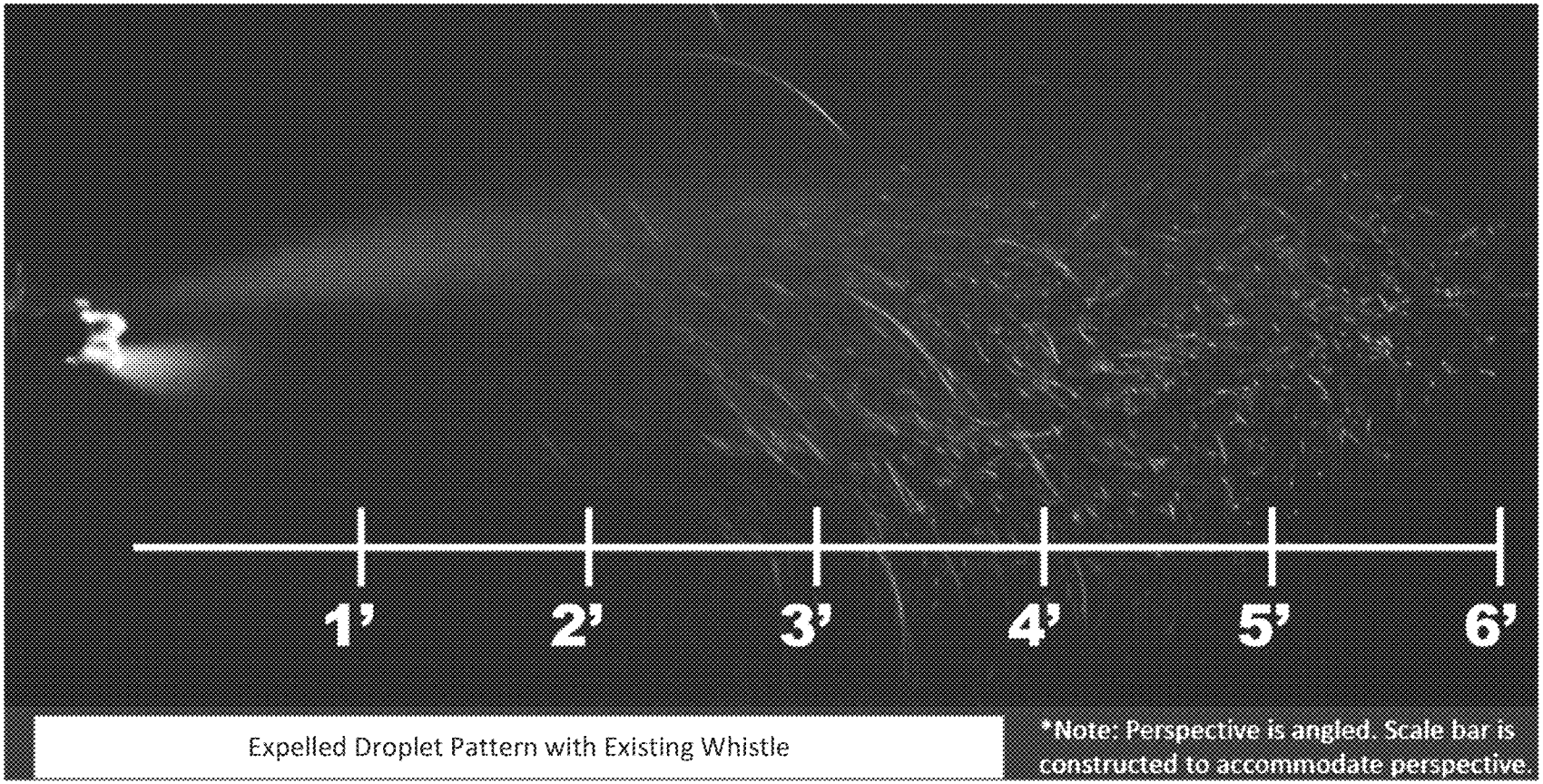
FIG. 27 illustrates an expelled droplet pattern resulting from the experimental setup of FIG. 26 in connection with an existing whistle.
Figure 28:
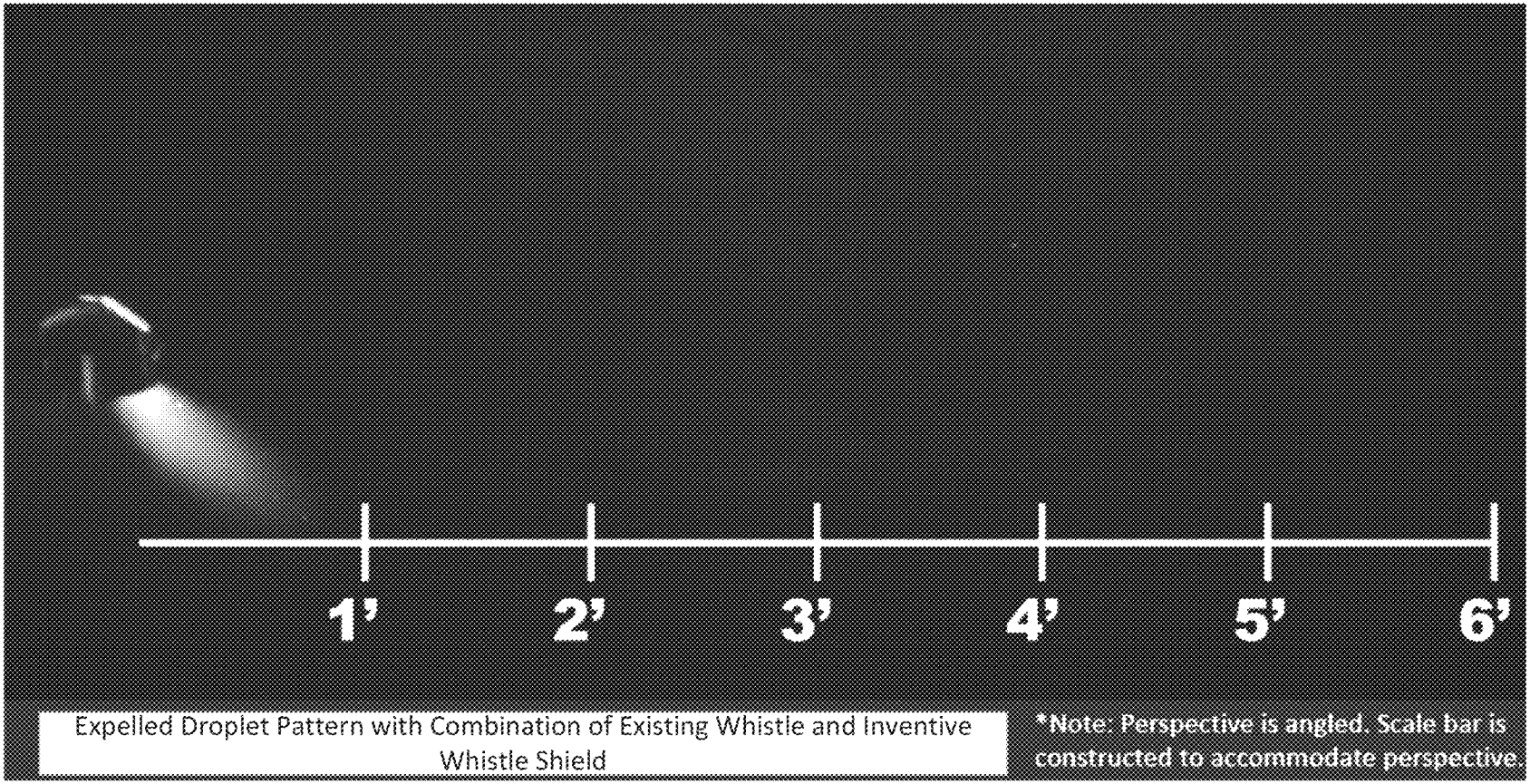
FIG. 28 illustrates an expelled droplet pattern resulting from the experimental setup of FIG. 26 in connection with a combination of an existing whistle and a whistle shield structured in accordance with certain embodiments of the present invention.
Figure 29:
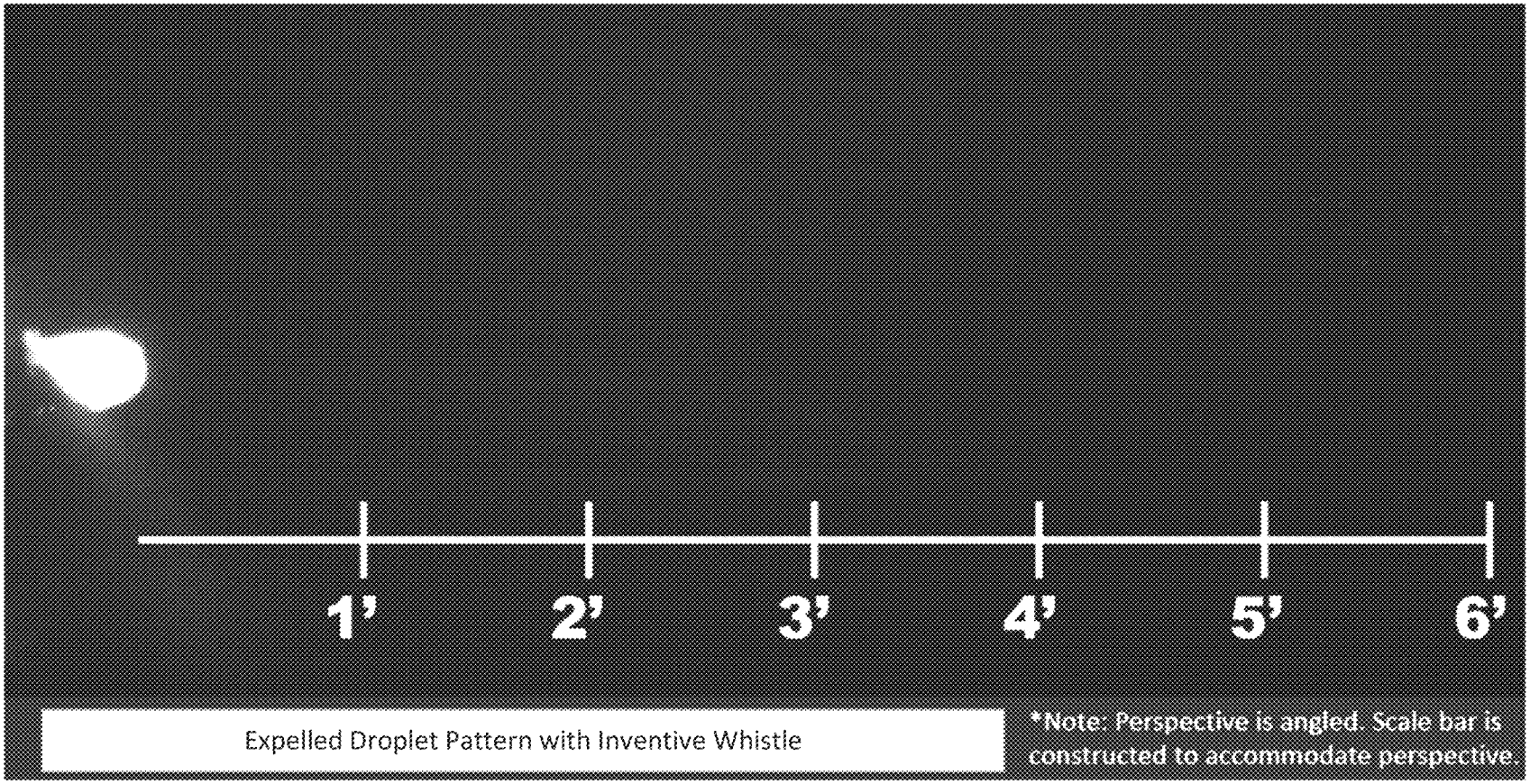
FIG. 29 illustrates an expelled droplet pattern resulting from the experimental setup of FIG. 26 in connection with a whistle structured in accordance with certain embodiments of the present invention.
Figure 30:
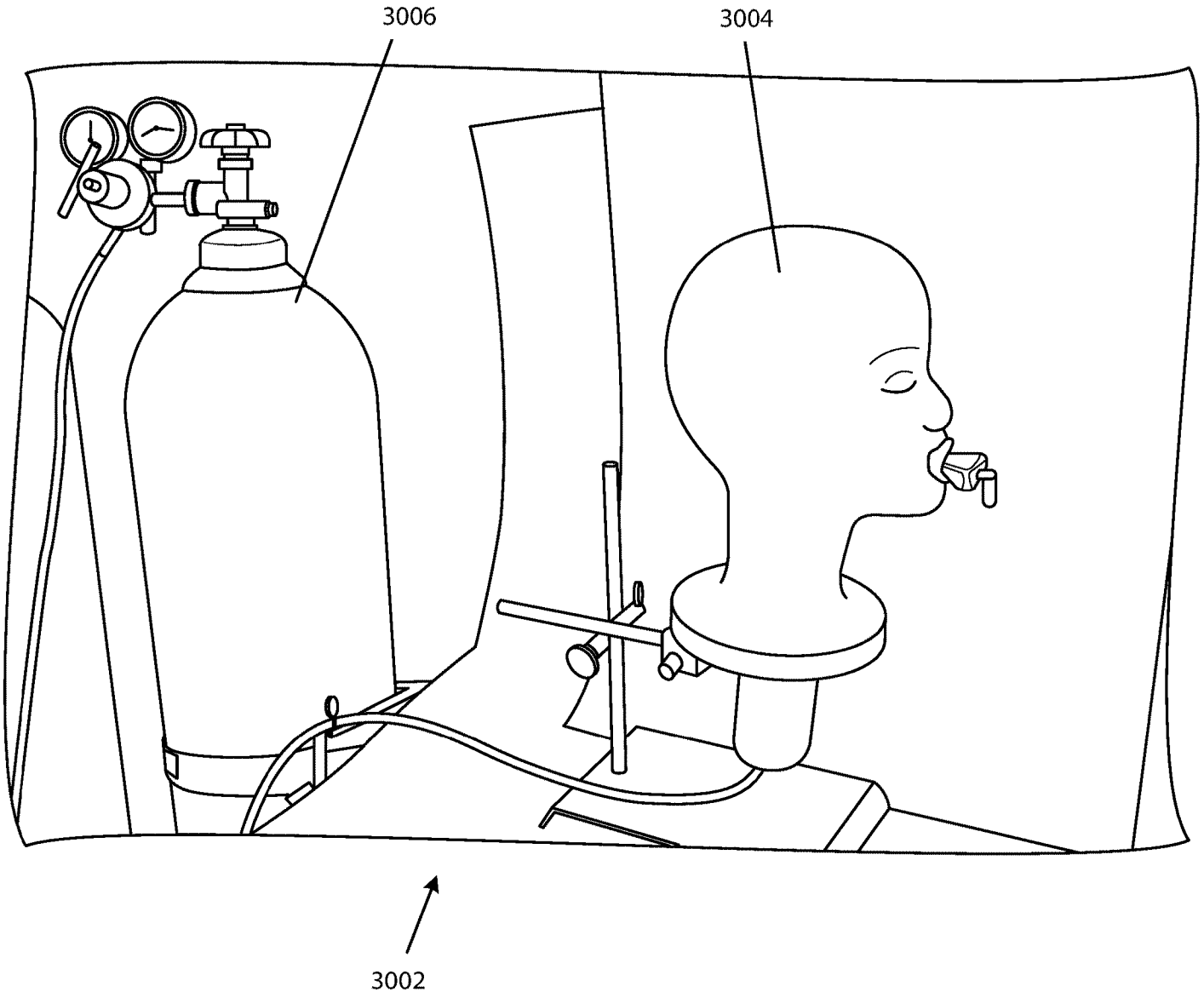
FIG. 30 illustrates another experimental setup involving a comparison of a whistle structured in accordance with embodiments of the invention described herein against an existing whistle design.

With regard to FIGS. 26 through 29, another experimental test was performed to compare certain aspects of a whistle structured in accordance with the whistle 102 described herein against an existing whistle structured in accordance with the existing whistle 2002 described herein. In connection with the experimental setup shown in FIG. 26, a custom laser line generator was fabricated using a Class 2 laser at 532 nm (green), mounted 6.5' horizontal distance from the tested whistle. The laser line illuminated a vertically-oriented plane of light measuring ~1.25 mm thick at 6.5'. Droplets expelled by each whistle within the plane of the laser were brilliantly illuminated in the darkened room via laser scattering effect. Images were captured using a 1 second exposure and ISO of 3200. FIG. 27 illustrates an expelled droplet pattern resulting from the experimental setup of FIG. 26 in connection with an existing whistle. FIG. 28 illustrates an expelled droplet pattern resulting from the experimental setup of FIG. 26 in connection with a combination of an existing whistle and a whistle shield structured in accordance with certain embodiments of the present invention. FIG. 29 illustrates an expelled droplet pattern resulting from the experimental setup of FIG. 26 in connection with a whistle structured in accordance with certain embodiments of the present invention. This laser line flow field imaging experiment revealed droplets expelled by an existing whistle 2002 traveled a distance of greater than 6'. The whistle shield attachment (e.g., structured like whistle shield 1902) reduced detected droplet travel to under 1'. The inventive whistle 102 significantly retained droplets, with faint droplet emission visible within two to three inches of the whistle.

With regard to FIGS. 30 through 35, another experimental test was performed to compare certain aspects of a whistle structured in accordance with the whistle 102 described herein against an existing whistle structured in accordance with the existing whistle 2002 described herein. In this experiment, a series of loudness tests were performed on whistles structured like the two whistles 102, 2002. The purpose of these tests was to compare the performance of the whistles 102, 2002, and the comparison entailed measurement of sound decibel levels produced by the whistles 102, 2002 when gas flow profiles, experimental environments, and whistle-to-sound meter distances were varied.

To perform a comparison between the sound levels generated by the whistles 202, 2002, a series of standardized experiments utilizing repeatable configurations were implemented to record the sound levels observed by each whistle. This included using a whistle testing apparatus 3002 (see FIG. 30) designed to mimic human actuation of a whistle, and with the ability to regulate the airflow delivered to the whistle. The apparatus 3002 consisted of a Styrofoam mannequin head 3004 with a cavity connected to a compressed gas (nitrogen) bottle 3006. Specifically, a cavity was cored through the mannequin 3004 mouth that connected to a passageway that is in the approximate location of the human spine. The base of this "spine" passageway was sealed to a 250 mL bottle. The base of the 250 mL bottle contained a 0.25" diameter hole that was connected, via tubing, to the bottle of compressed nitrogen 3006. The flow of nitrogen was controlled with an analog gas regulator equipped with a 0.5 bar graduated pressure scale. The volume of the gas path created by this design was approximately 21 cubic inches. This includes the cored cavity (0.25" diameter×3" cylinder), the spine cavity (1" diameter×6" cylinder), the 250 mL bottle, and regulator-to-bottle tubing (0.25" diameter×216" cylinder).

Due to differences in whistle geometries and the necessity to change whistles to perform these tests, a seal was produced between the mannequin 3004 mouth and the whistle using Paraffin "M" Laboratory Film. Prior to the whistle tests, the seal was tested via audible sound quality of the whistle when the compressed gas was passed through the system. Sound loudness was detected in decibels using a Digi-Sense Data Logging Sound Meter with NIST-Traceable Calibration. Measurements were performed with a 125 ms sampling rate on an A-weighted frequency rating (dBA) scale. This sound meter has a specified accuracy level of +1.4 dB.

To approximate the volume of air expelled during the whistle test, the Microlife® Digital Peak Flow & FEV1 Meter Model PF100 spirometer was used to monitor peak flow at the utilized pressure levels. Due to the geometry of the spirometer and the necessity for backpressure in whistle operation, these airflow measurements are approximations as to what was achieved during the mannequin head tests. This spirometer used a rotating wheel measurement method with a range of peak flow value (PFV) of 50 to 900 L/min. The accuracy is listed as ±25 L/min or 12% of the observed PFV reading. The resolution of the spirometer is 1 L/min.

A series of multiple whistle-blowing experiments were conducted using the two whistles 102, 2002. Control variables were the (a) sampling environment, (b) distance from whistle-to-sound meter, and (c) the gas pressure delivered to the whistle apparatus. For each data point in this three-dimensional sampling matrix, both whistles 102, 2002 were tested with the whistle apparatus 3002. FIG. 31 includes a table summarizing the experimental matrix. Two sampling environments were used for the whistle tests. This included an indoor and outdoor setting and was intended to capture the different environments in which these whistles may be used. The indoor setting was a warehouse with an approximately 20' ceiling. The warehouse was 100' long and 100' wide at its extreme dimensions, but irregular protrusions of adjacent rooms result in a warehouse volume of approximately 127,000 cubic ft. The warehouse was not empty and contained shelving, which may have contributed to sound reflection and absorption during the testing. The shelving was approximately 18' high; not extending to the ceiling. The corridor where the sound tests were performed was approximately 100'×50'×20'. Outdoor tests were performed in the exterior lot of a facility at 800 Presque Isle facility in Plum, Pa. on the afternoons of May 13, 2021, and May 17, 2021. Temperatures were in the low 60's on May 13 and low 70's on May 17. On both sampling days, wind speeds were light. The mannequin 3004 head was approximately 150' from the nearest structure and no artificial obstacles were placed on the flat, grass surface between the mannequin 3004 head and the sound meter.

In both the indoor and outdoor test environments, two source-to-sound meter distances were used for whistle loudness observations. Both environments had sound measurements performed 10'. The indoor environment was spatially more restrictive, resulting in an additional test at 25'. A second outdoor test was performed at 50'. For all tests, both the whistle and sound meter were positioned approximately 5' off the ground. Using the whistle apparatus, two gas pressure settings were used to produce sound via each whistle. In each instance, the same gas pressures were used for each whistle 102, 2002. While some pressures exceeding those presented in this report were achieved, the results are not presented because either the quality of sound emanating from the whistle was poor or excessive variability in the loudness (usually due to the whistle being dislodged with higher gas pressures) was observed.

To produce sound with the whistle apparatus, the regulator was set to a fixed pressure setting. Pressure levels of 0.5 bar and 1.0 bar were used for the tests. To replicate the rapid expulsion of air that is typical of sound production with a whistle, the tubing between the regulator and 250 mL bottle was pinched and released in rapid increments. This was performed multiple times to produce an approximately repeatable gas pulse that passed through the whistle to produce the signal recorded with the sound meter. The sequence of testing was such that a fixed distance and whistle were cycled through the two pressure settings, then the second whistle was inserted, and the same test was performed. This process reduced variations associated with source-to-meter distances and possible environmental differences.

Figure 34:
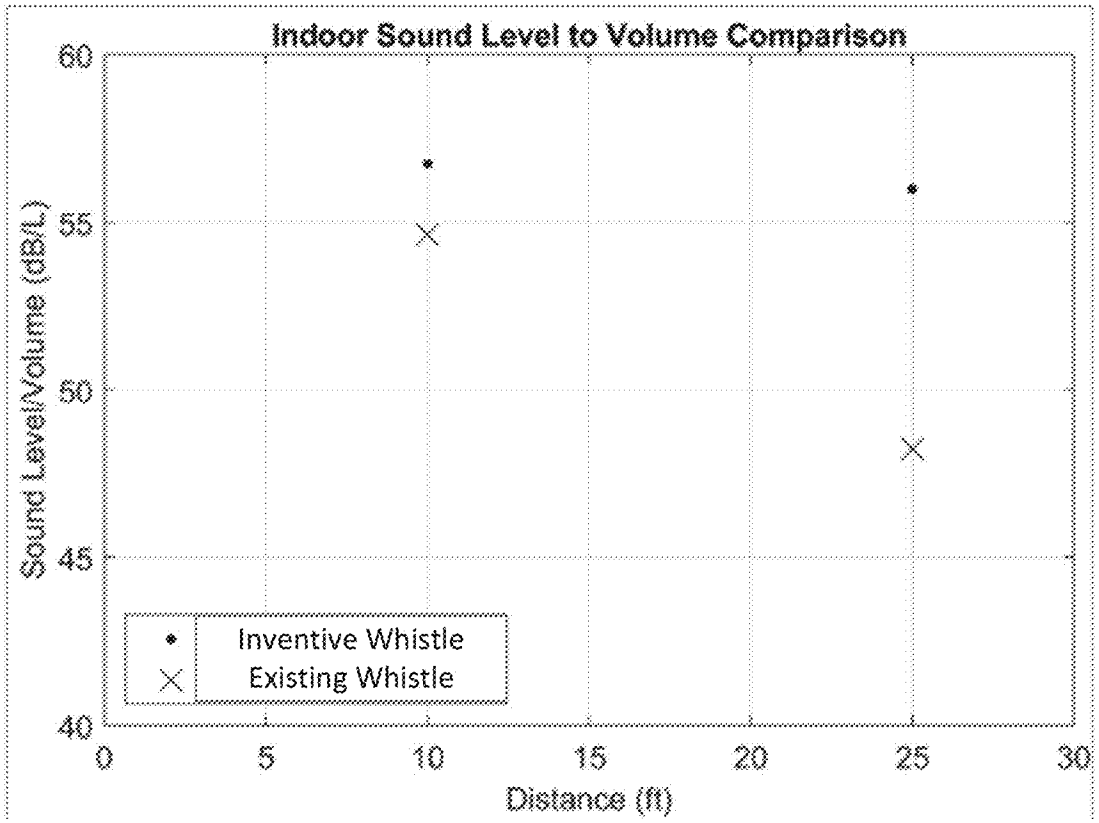
FIGS. 34 and 35 include graphical representations of certain data derived from the table of FIG. 33.
Figure 35:
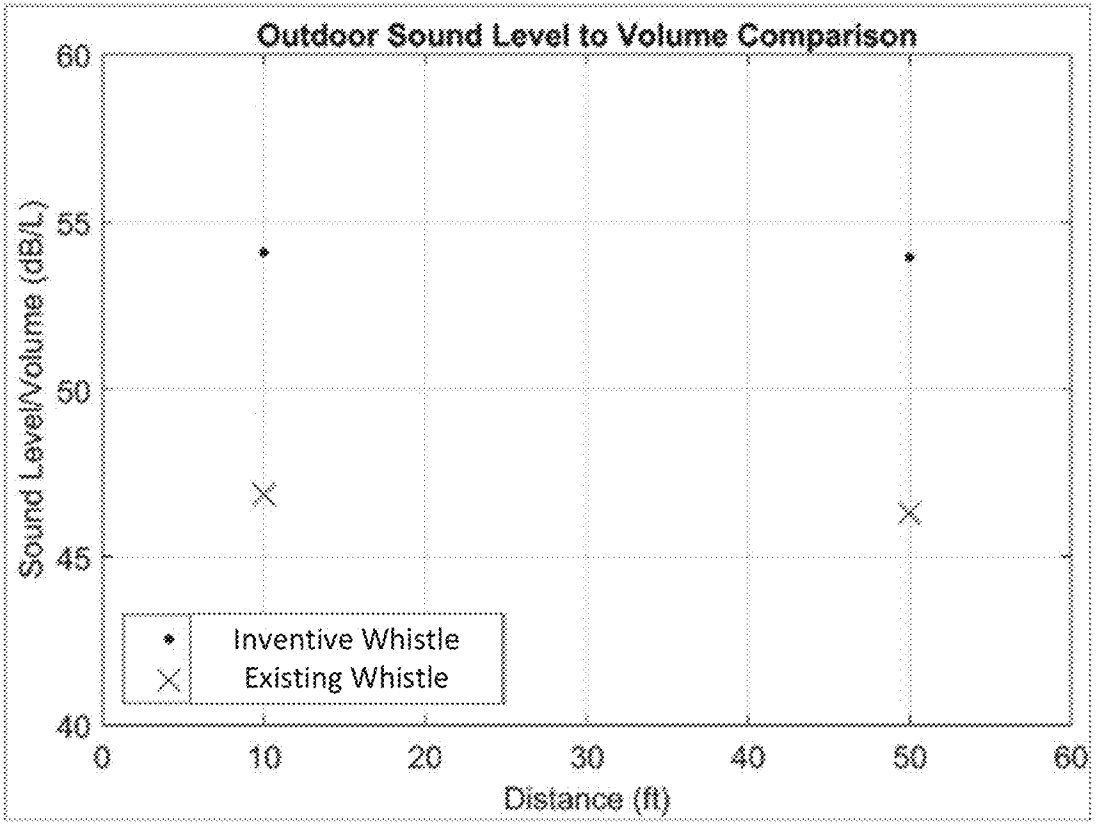

Measurements of the peak air flow were performed with the aforementioned spirometer. The tubing that was inserted into the 250 mL bottle during the whistle tests was directly inserted into the spirometer measurement channel. Gas pulses, similar to those produced in the whistle tests, were generated at 0.5 and 0.1 bar. The averages of these measurements were used to estimate the gas volumes expelled during the tests. These averages are summarized in the table shown in FIG. 32 for both the indoor and outdoor measurements. The whistle profile was also correlated to an expelled volume of gas. Using the measured duration of each sound pulse, a volume could be tabulated for each whistle blowing event. Specifically, the volume was calculated as the product of the average peak flow rate and the duration of each impulse. The average of these ratios was then calculated for a given experimental setup (whistle type, source-to-sound meter distance, environment). This data is presented in the table shown in FIG. 33 and graphically in FIGS. 34 and 35. The data are averaged over the 0.5 bar and 1.0 bar results. FIG. 34 depicts an average ratio between peak sound level-to-impulse gas volume as a function of distance for indoor measurements. FIG. 35 depicts an average ratio between peak sound level-to-impulse gas volume as a function of distance for outdoor measurements. In summary, it can be seen that for both indoor and outdoor test environments, calculations of the ratio of average loudness to expelled air volume for the inventive whistle 102 were not only equivalent to the conventional whistle 2002 but also higher in all scenarios.

It can be appreciated, therefore, that whistles structured in accordance with embodiments of the present invention address deficiencies in conventional whistles. Namely, the whistle 102 reduces the amount of air pressure required to be blown through the inlet and sound-generating chambers of the whistle 102 necessary to generate a suitable sound from the whistle. This benefit is clearly helpful to those users suffering from medical conditions or diseases such as asthma, chronic obstructive pulmonary disease (COPD), chronic bronchitis, or emphysema, among others. Such users may often find it difficult to generate air pressure with the consistency and regularity necessary to use a whistle effectively, especially whistles existing prior to development of the embodiments of the present invention. Furthermore, the results of the experimental studies described herein support the conclusion that the structure of the inventive whistle 102 inherently reduces the total amount of airborne particles introduced into the environment as a beneficial consequence of requiring less inlet air pressure for effective use of the whistle 102. In addition, these experimental studies support how various embodiments of the inventive whistle design not only reduce the volume of potentially harmful particles which might be disseminated through the environment, but also can redirect those particles generally downwardly and away from other people located within the environment.

It is to be understood that certain descriptions of the embodiments described herein have been simplified to illustrate only those elements, features, and aspects that are relevant to a clear understanding of the disclosed embodiments, while eliminating, for purposes of clarity, other elements, features, and aspects, Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference, Any mated al, or portion thereof, that is said to be incorporated by reference herein, but which conflicts with existing definitions, statements, or other disclosure material set forth herein is only incorporated to the extent that no conflict arises between that incorporated material and the existing disclosure material.

For purposes of the detailed description, it is to be understood that the invention may involve various, alternative composition variations and step sequences, except where expressly specified to the contrary. Moreover, other than in any operating examples, or where otherwise indicated, all numbers such as those expressing values, amounts, percentages, ranges, subranges and fractions may be read as if prefaced by the word "about," even if the term does not expressly appear. Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Where a closed or open-ended numerical range is described herein, all numbers, values, amounts, percentages, subranges and fractions within or encompassed by the numerical range are to be considered as being specifically included in and belonging to the original disclosure of this application as if these numbers, values, amounts, percentages, subranges and fractions had been explicitly written out in their entirety. Recitation of ranges of values herein is merely intended to serve as a shorthand method of referring individually to each separate value falling within the range. Unless otherwise indicated herein, each individual value is incorporated into the specification as if it were individually recited herein.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with statutory requirements.

As used herein, unless indicated otherwise, a plural term can encompass its singular counterpart and vice versa, unless indicated otherwise. In addition, in this application, the use of "or" means "and/or" unless specifically stated otherwise, even though "and/or" may be explicitly used in certain instances. As used herein, the terms "including," "containing," and like terms are understood in the context of this application to be synonymous with "comprising" and are therefore open-ended and do not exclude the presence of additional undescribed or unrecited elements, materials, ingredients or method steps.

Reference to "one embodiment" or "an embodiment" means that a particular feature, structure, or characteristic described in connection with the embodiment is comprised in at least one embodiment. The appearances of the phrase "in one embodiment" or "in one aspect" in the specification are not necessarily all referring to the same embodiment. The terms "a" and "an" and "the" and similar referents used in the context of the present disclosure (especially in the context of the following claims) are to be construed to cover both the singular and the plural, unless otherwise indicated herein or clearly contradicted by context.

The use of any and all examples, or exemplary language (e.g., "such as" or "for example") provided herein is intended merely to better illuminate the disclosed embodiments and does not pose a limitation on the scope otherwise claimed. No language in the specification should be construed as indicating any non-claimed element essential to the practice of the claimed subject matter. It is further noted that the claims may be drafted to exclude any optional element. As such, this statement is intended to serve as antecedent basis for use of such exclusive terminology as solely, only and the like in connection with the recitation of claim elements, or use of a negative limitation.

Any element expressed herein as a means for performing a specified function is intended to encompass any way of performing that function including, for example, a combination of elements that performs that function. Furthermore, the invention, as may be defined by such means-plus-function claims, resides in the fact that the functionalities provided by the various recited means are combined and brought together in a manner as defined by the appended claims. Therefore, any means that can provide such functionalities may be considered equivalents to the means shown herein.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

It will be appreciated that those skilled in the art will be able to devise various arrangements which, although not explicitly described or shown herein, embody the principles of the present disclosure and are comprised within the scope thereof. Furthermore, all examples and conditional language recited herein are principally intended to aid the reader in understanding the principles described in the present disclosure and the concepts contributed to furthering the art, and are to be construed as being without limitation to such specifically recited examples and conditions. Moreover, all statements herein reciting principles, aspects, and embodiments as well as specific examples thereof, are intended to encompass both structural and functional equivalents thereof. Additionally, it is intended that such equivalents comprise both currently known equivalents and equivalents developed in the future, i.e., any elements developed that perform the same function, regardless of structure. The scope of the present disclosure, therefore, is not intended to be limited to the exemplary aspects and aspects shown and described herein.

Groupings of alternative elements or embodiments disclosed herein are not to be construed as limitations. Each group member may be referred to and claimed individually or in any combination with other members of the group or other elements found herein. It is anticipated that one or more members of a group may be comprised in, or deleted from, a group for reasons of convenience and/or distinguishing the scope of the claimed invention.

While various embodiments of the invention have been described herein, it should be apparent that various modifications, alterations and adaptations to those embodiments may occur to persons skilled in the art with the attainment of some or all of the advantages of the present invention. The disclosed embodiments are therefore intended to include all such modifications, alterations, and adaptations without departing from the scope and spirit of the present invention as claimed herein.

What is claimed is:

1. A whistle comprising:

a body portion;

an air inlet of the body portion structured for receiving air therein supplied by a source of air pressure applied to the air inlet;

a channelizer in fluid communication with the air inlet, the channelizer configured for dividing air flow received from the air inlet through at least two channels;

at least one sound-generating chamber corresponding to and in fluid communication with each of the channels;

at least one air exhaust in fluid communication with the sound-generating chamber, the air exhaust:

structured for generating a sound by releasing air from the sound-generating chamber in response to a threshold air pressure generated within the sound-generating chamber, and positioned and structured at a location on the whistle body for directing air flow away from the air exhaust in a generally downwardly direction with respect to a direction of a generally horizontal air flow into the air inlet, and at least a portion of the air exhaust being structured for directing at least a portion of the air flow from the air exhaust in a direction opposite to the direction of the generally horizontal air flow into the air inlet.

2. The whistle of claim 1, further comprising at least one sound-generating chamber comprising a generally cylindrical tube extending from its corresponding channel to its corresponding air exhaust.

3. The whistle of claim 1, wherein at least a part of the body portion comprises a plastic material.

4. The whistle of claim 1, wherein at least a part of the body portion comprises a metal material.

5. The whistle of claim 1, wherein at least a part of the body portion comprises a wood material.

6. The whistle of claim 1, further comprising an oral grip positioned adjacent to the air inlet and configured for receiving and interfacing with a mouth or lips of a user thereon.

7. The whistle of claim 1, further comprising the body portion comprising at least one separate cavity which is not in fluid communication with the sound-generating chamber.

8. The whistle of claim 1, further comprising a separate and removable external cover positioned to cover at least a portion of the whistle body.

9. The whistle of claim 1, wherein at least one sound-generating chamber defines a volumetric space formed between: (a) a plane of fluid communication interface between the chamber and its corresponding channel, and (b) a plane of fluid communication interface between the chamber and its corresponding air exhaust.

10. The whistle of claim 9, wherein a volume of the defined volumetric space is in the range of 1,300 $mm^3$ to 1,500 $mm^3$.

11. The whistle of claim 10, wherein a volume of the defined volumetric space is further in the range of 1,350 $mm^3$ to 1,400 $mm^3$.

* * * * *